US008139968B2

(12) United States Patent
Katoh et al.

(10) Patent No.: US 8,139,968 B2
(45) Date of Patent: Mar. 20, 2012

(54) IMAGE FORMING APPARATUS

(75) Inventors: Tsutomu Katoh, Kawasaki (JP); Kazuosa Kuma, Yokohama (JP); Takeshi Fukao, Yokohama (JP); Yoshiharu Kishi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 426 days.

(21) Appl. No.: 12/488,021

(22) Filed: Jun. 19, 2009

(65) Prior Publication Data

US 2009/0317104 A1 Dec. 24, 2009

(30) Foreign Application Priority Data

Jun. 20, 2008 (JP) ..... 2008-161439

(51) Int. Cl.
*G03G 15/16* (2006.01)

(52) U.S. Cl. ..... 399/66; 399/297; 399/154

(58) Field of Classification Search ..... 399/66, 399/154, 302, 297
See application file for complete search history.

(56) References Cited

U.S. PATENT DOCUMENTS

| | | | | |
|---|---|---|---|---|
| 6,445,900 | B2 | 9/2002 | Fukao et al. | |
| 6,868,248 | B2 | 3/2005 | Fukao et al. | |
| 7,274,897 | B2 | 9/2007 | Katoh | |
| 7,499,665 | B2 | 3/2009 | Kuma et al. | |
| 7,509,073 | B2 | 3/2009 | Katoh et al. | |
| 2005/0025538 | A1* | 2/2005 | Omata | 399/329 |
| 2005/0286930 | A1* | 12/2005 | Sawai et al. | 399/167 |
| 2007/0127955 | A1 | 6/2007 | Katoh et al. | |
| 2008/0175619 | A1 | 7/2008 | Katoh et al. | |

FOREIGN PATENT DOCUMENTS

| | | |
|---|---|---|
| JP | 3-256067 | 11/1991 |
| JP | 8-227201 | 9/1996 |
| JP | 9-211911 | 8/1997 |
| JP | 11-194578 | 7/1999 |
| JP | 2002-197274 | 7/2002 |
| JP | 2003-173091 | 6/2003 |
| JP | 3464850 | 8/2003 |
| JP | 2004-220006 | 8/2004 |
| JP | 2005-189493 | 7/2005 |
| JP | 2005-210469 | 8/2005 |
| JP | 2006-235560 | 9/2006 |

* cited by examiner

*Primary Examiner* — David Gray
*Assistant Examiner* — Roy Y Yi
(74) *Attorney, Agent, or Firm* — Oblon, Spivak, McClelland, Maier & Neustadt, L.L.P.

(57) ABSTRACT

An image forming apparatus includes an image forming mechanism, a transfer mechanism including a first endless belt receiving a toner image formed on an image carrier and a second endless belt receiving the toner image formed on the first endless belt, a first detector to detect a speed of movement of the first endless belt or a toner image transferred at a predetermined position on the first endless belt, a belt speed adjustment unit to adjust a speed of movement of the first endless belt based on results obtained by the first detector, a second detector to detect the toner image transferred at a predetermined position on the second endless belt, and a transfer adjustment unit to adjust a speed of movement of the second endless belt based on results obtained by the second detector.

20 Claims, 15 Drawing Sheets

IMAGE FORMING APPARATUS

CROSS-REFERENCE TO RELATED APPLICATIONS

The present invention claims priority pursuant to 35 U.S.C. §119 from Japanese Patent Application No. 2008-161439, filed on Jun. 20, 2008 in the Japan Patent Office, the contents and disclosure of which are hereby incorporated by reference herein in their entirety.

BACKGROUND OF THE INVENTION

1. Field of the Invention

Exemplary embodiments of the present invention generally relate to an image forming apparatus, and more particularly, to an image forming apparatus that transfers a toner image formed on an image carrier onto a first endless belt before transferring the toner image onto either a second endless belt directly or onto a recording medium on the second endless belt.

2. Discussion of the Related Art

In electrophotographic image forming apparatuses, changes in temperature, humidity, or other environmental changes can change characteristics of toner and/or other components of the image forming apparatus, causing unwanted fluctuations in output image density (hereinafter also referred to as image concentration), which is an amount of adhered toner per unit area of a recording medium.

Several techniques have been proposed to reduce the changes in image concentration caused by such environmental changes.

For example, in some related-art image forming apparatuses, a toner image formed on an image carrier according to image data transmitted from an external personal computer or the like is transferred onto a recording medium conveyed by an endless transfer belt. In addition, at given time intervals determined, for example, by number of sheets, etc., a pattern image including a toner image having a given shape is formed on the image carrier and transferred onto the surface of the endless transfer belt to enable a reflection-type photosensor to detect an amount of toner adhering to the toner image of the pattern image. Image forming conditions such as development potential, light intensity for writing a latent image, and the like are then adjusted based on the detection results obtained by the reflection-type photosensor. Such adjustment can provide a constant image concentration.

In other related-art image forming apparatuses, a toner image formed on an image carrier is transferred onto a first endless belt or an intermediate transfer belt, and the toner image on the intermediate transfer belt is then transferred onto a recording medium conveyed by a second endless belt or by a sheet conveyance belt. A drawback of such a configuration is that, if the thickness of the intermediate transfer belt and/or the diameter of a roller for driving the intermediate transfer belt vary due to environmental changes, an average speed per rotation of the intermediate transfer belt can be affected as well, causing distortion of the toner image transferred onto the intermediate transfer belt.

To prevent such a problem, the intermediate transfer belt is provided with scales having marks each of which is located at a given pitch along the intermediate transfer belt, so that a sensor can detect the average speed of movement of the intermediate transfer belt based on the time interval between the passage of successive marks past a given point. According to these detection results, the driving speed of a motor that drives the intermediate transfer belt can be adjusted, thereby keeping the intermediate transfer belt moving at a given average speed.

In addition to the above-described detection method, the average speed of movement of the intermediate transfer belt can be detected based on a speed of rotation of a driven roller that extends the intermediate transfer belt. Yet another known detection method involves a pattern image consisting of multiple toner images arranged at predetermined pitches that is transferred onto the intermediate transfer belt. The average speed of movement of the intermediate transfer belt can then be detected based on the time interval between passages past a given point of successive multiple toner images of the pattern image formed on the intermediate transfer belt.

However, such an image forming apparatus including the intermediate transfer belt that moves at a predetermined average speed cannot prevent distortion of an output image. Even if the intermediate transfer belt moves at a predetermined average speed, when a sheet conveyance belt moves at a speed different from a predetermined or reference speed because of a change in diameter of a roller supporting the sheet conveyance belt, the toner image may still be distorted during transfer from the intermediate transfer belt onto a recording medium conveyed by the sheet conveyance belt. Such image distortion can also occur when a toner image is transferred from the first transfer belt onto the second transfer belt.

Further, when a toner image transferred from the image carrier onto the intermediate transfer belt is further transferred onto a recording medium, even if the image forming conditions are adjusted as described above, an output image to be formed on the recording medium cannot acquire a preferable image concentration because the concentration of the output image can become insufficient if a transfer failure occurs and a large amount of transfer dust is produced in a subsequent transfer process.

SUMMARY OF THE INVENTION

Exemplary aspects of the present invention have been made in view of the above-described circumstances.

Exemplary aspects of the present invention provide an image forming apparatus that can obtain useful information to detect image degradation caused when a toner image is transferred from a first endless belt onto either the surface of a second endless belt or a recording medium conveyed on the second endless belt.

In one exemplary embodiment, an image forming apparatus includes an image forming mechanism, a transfer mechanism, a first detector, a belt speed adjustment unit, a second detector, and a transfer adjustment unit. The image forming mechanism forms a toner image on a surface of an image carrier. The transfer mechanism is disposed in the vicinity of the image forming mechanism to transfer the toner image formed on the surface of an image carrier onto a first endless belt and further onto a second endless belt. The first endless belt is partly held in contact with the image carrier to receive the toner image formed on the image carrier. The second endless belt is partly held in contact with the first endless belt to receive the toner image from the first endless belt. The second endless belt receives the toner image from the first endless belt either directly on a surface thereof or via a recording medium conveyed on the second endless belt. The first detector detects one of a speed of movement of the first endless belt and a toner image transferred at a predetermined position on the surface of the first endless belt. The belt speed adjustment unit adjusts a speed of movement of the first endless belt based on detection results obtained by the first detector. The second detector detects the toner image transferred at a predetermined position on the surface of the second endless belt. The transfer adjustment unit adjusts a speed of movement of the second endless belt based on detection results obtained by the second detector.

The above-described image forming apparatus may further include an image forming adjustment unit to adjust operation of the image forming mechanism based on detection results obtained by the first detector.

The image forming mechanism may include multiple image carriers corresponding to toner images of different colors. The transfer mechanism may transfer the toner images of different colors formed on the multiple image carriers onto the first endless belt. The image forming adjustment unit may adjust positions of the toner images formed on the first endless belt based on detection results obtained by the first detector detecting the toner images of different colors formed on the first endless belt.

Further, in one exemplary embodiment, an image forming apparatus includes an image forming mechanism, a transfer mechanism, a residual image detector, and a belt image detector. The image forming mechanism forms a toner image on a surface of an image carrier. The transfer mechanism is disposed in the vicinity of the image forming mechanism to transfer the toner image formed on the surface of the image carrier onto a first endless belt and further onto a second endless belt. The first endless belt is partly held in contact with the image carrier to receive the toner image formed on the image carrier. The second endless belt is partly held in contact with the first endless belt to receive the toner image from the first endless belt. The second endless belt receives the toner image from the first endless belt either directly on a surface thereof or via a recording medium conveyed on the second endless belt. The residual image detector detects a residual image remaining on the surface of the first endless belt at a predetermined position thereon after the toner image is transferred either directly onto the surface of the second endless belt or via the recording medium conveyed on the second endless belt. The belt image detector is disposed facing the second endless belt across a gap to detect the toner image transferred at a predetermined position on the surface of the second endless belt and a toner concentration of the toner image.

The above-described image forming apparatus may further include a transfer adjustment unit to adjust a transfer rate of the toner image transferred from the first endless belt onto the second endless belt based on detection results obtained by the residual image detector and detection results obtained by the belt image detector.

The above-described image forming apparatus may further include an image formation adjustment unit to adjust an image formation concentration based on the detection results obtained by the residual image detector and detection results obtained by the belt image detector.

The image forming mechanism may include multiple image carriers corresponding to toner images of different colors. The transfer mechanism may transfer toner images of different colors formed on multiple image carriers onto the first endless belt. The belt image detector may detect the toner images of different colors transferred from the first endless belt onto the second endless belt. The image formation adjustment unit may adjust positions of each of the toner images of different colors on the first endless belt, based on detection results of the belt image detector.

The residual image detector may include a specular reflection photosensor to receive specular reflection light.

Further, in one exemplary embodiment, an image forming apparatus includes an image forming mechanism, a transfer mechanism, and a transferred image detector. The image forming mechanism forms a toner image on a surface of an image carrier. The transfer mechanism is disposed in the vicinity of the image forming mechanism to transfer the toner image formed on the surface of the image carrier onto a first endless belt and further onto a second endless belt. The first endless belt is partly held in contact with the image carrier to receive the toner image formed on the image carrier. The second endless belt is partly held in contact with the first endless belt to receive the toner image from the first endless belt onto a recording medium conveyed on the second endless belt. The toner image transferred from the first endless belt onto a predetermined position on a surface of the recording medium. The transferred image detector detects the toner image transferred from the first endless belt onto the recording medium.

The above-described image forming apparatus may further include a transfer adjustment unit to adjust a speed of movement of the second endless belt based on detection results obtained by the transferred image detector.

The above-described image forming apparatus may further include a detector to detect one of a speed of movement of the first endless belt and the toner image transferred at a predetermined position onto the surface of the first endless belt, and a belt speed adjustment unit to adjust a speed of movement of the first endless belt based on detection results obtained by the detector.

The transferred image detector may further detect a toner concentration of the toner image formed on the recording medium. The above-described image forming apparatus may further include a transfer adjustment unit to adjust a transfer current for forming a transfer electric field to contribute to a transfer of the toner image from the first endless belt onto the recording medium based on detection results obtained by the transferred image detector.

The above-described image forming apparatus may further include a first detector disposed facing the first endless belt across a gap to detect the toner image transferred at a predetermined position onto the surface of the first endless belt and a toner concentration of the toner image, and an image formation adjustment unit to adjust operation of the image forming mechanism based on detection results obtained by the first detector.

Based on detection results of toner concentrations of the toner images obtained by the transferred image detector, the transfer adjustment unit may transfer the toner image formed on the first endless belt onto the recording medium with multiple transfer currents and adjusts the transfer currents when an image is formed according to image forming instructions issued by operator.

The transfer adjustment unit may determine the transfer current based on a transfer current value determined as the transfer adjustment unit adjusts the transfer currents.

The image carrier may include multiple image carriers corresponding to toner images of different colors, and the transfer mechanism may transfer the toner images of different colors formed on the multiple image carriers onto the first endless belt. The above-described image forming apparatus may further include a first detector disposed facing the first endless belt across a gap to detect the toner image transferred at a predetermined position on the surface of the first endless belt, and an image formation adjustment unit to adjust positions of the toner images formed on the first endless belt based on detection results of the first detector detecting the toner images of different colors formed on the first endless belt.

The transferred image detector may be positioned to detect the toner image formed on the recording medium when the recording medium is conveyed on the second endless belt, and to detect the toner image formed on the surface of the second endless belt when the recording medium is not conveyed on the second endless belt. The transfer mechanism may transfer the toner image formed on the first endless belt onto the recording medium when the recording medium is conveyed on the second endless belt, and transfer the toner image formed on the first endless belt onto the surface of the second endless belt when the recording medium is not conveyed on the second endless belt.

The above-described image forming apparatus may further include a correction unit to correct detection results of the toner image formed on the surface of the second endless belt obtained by the transferred image detector, using detection results of the toner image formed on the recording medium obtained by the transferred image detector.

The second endless belt is detachably attachable to the image forming apparatus, and the above-described image forming apparatus may further include a positioning mechanism to position the transferred image detector in the image forming apparatus with reference to the location of the second endless belt.

The positioning mechanism positions the transferred image detector by engaging a holding member that holds the transferred image detector with a support member that supports the second endless belt provided in the image forming apparatus.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
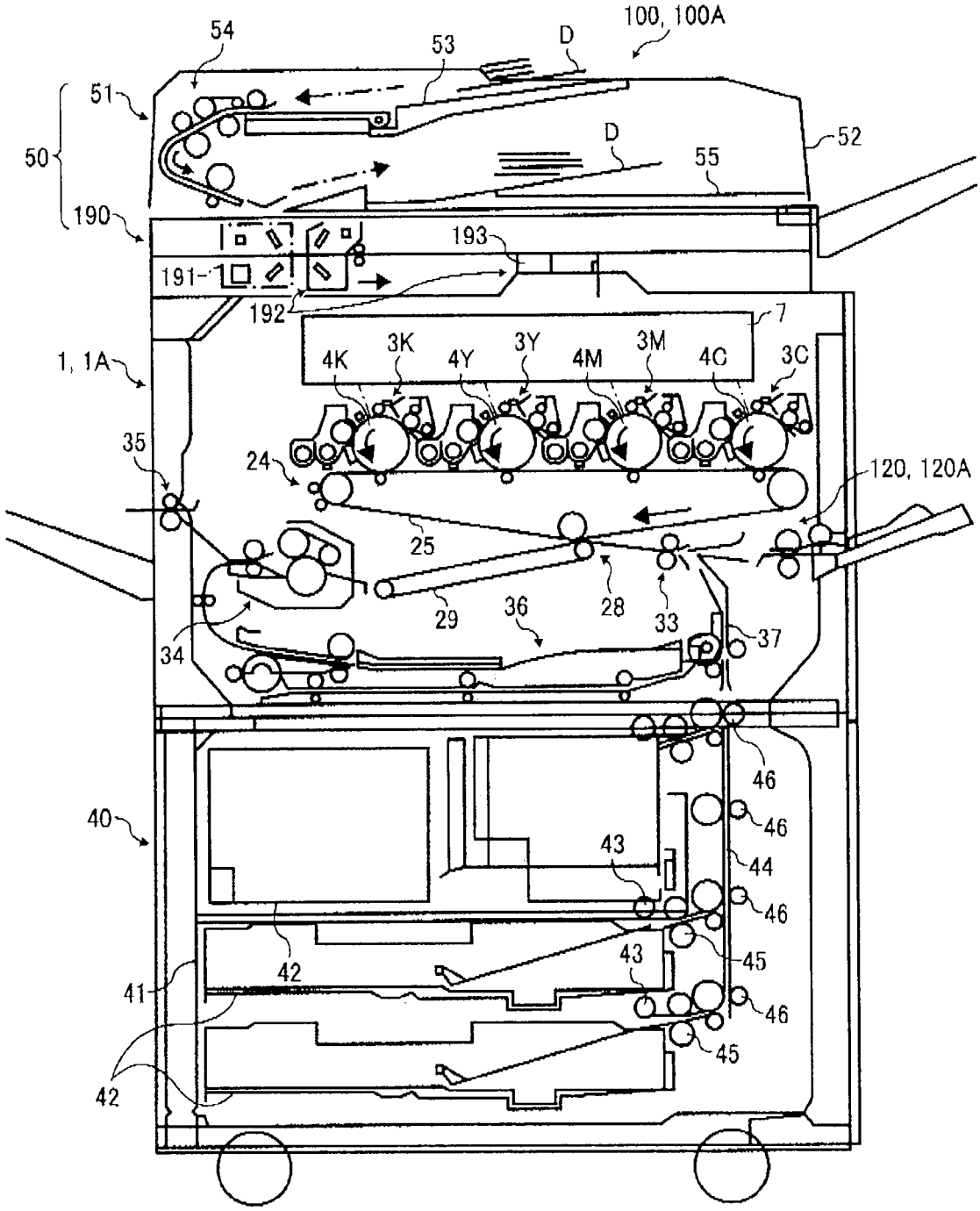
FIG. 1 is a cross-sectional view of a schematic configuration of an image forming apparatus according to Exemplary Embodiment 1 of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present patent application. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent application is not intended to be limited to the specific terminology so selected and it is to be understood that each specific element includes all technical equivalents that operate in a similar manner.

Referring now to the drawings, wherein like reference numerals designate identical or corresponding parts throughout the several views, example embodiments of the present invention are described.

Now, example embodiments of the present invention are described in detail below with reference to the accompanying drawings.

Descriptions are given, with reference to the accompanying drawings, of examples, exemplary embodiments, modification of exemplary embodiments, etc., of an image forming apparatus according to the present invention. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present invention.

The present invention includes a technique applicable to any image forming apparatus. For example, the technique of the present invention is implemented in the most effective manner in an electrophotographic image forming apparatus. In such an electrophotographic image forming apparatus, process cartridges and an intermediate transfer belt are used as an image forming mechanism and the intermediate transfer belt and a sheet conveyance belt are used as a transfer mechanism.

Among various types of electrophotographic image forming apparatuses, the present patent application explains techniques with a tandem-type image forming apparatus with an intermediate transfer method as representative examples.

Exemplary Embodiment 1

Figure 2:
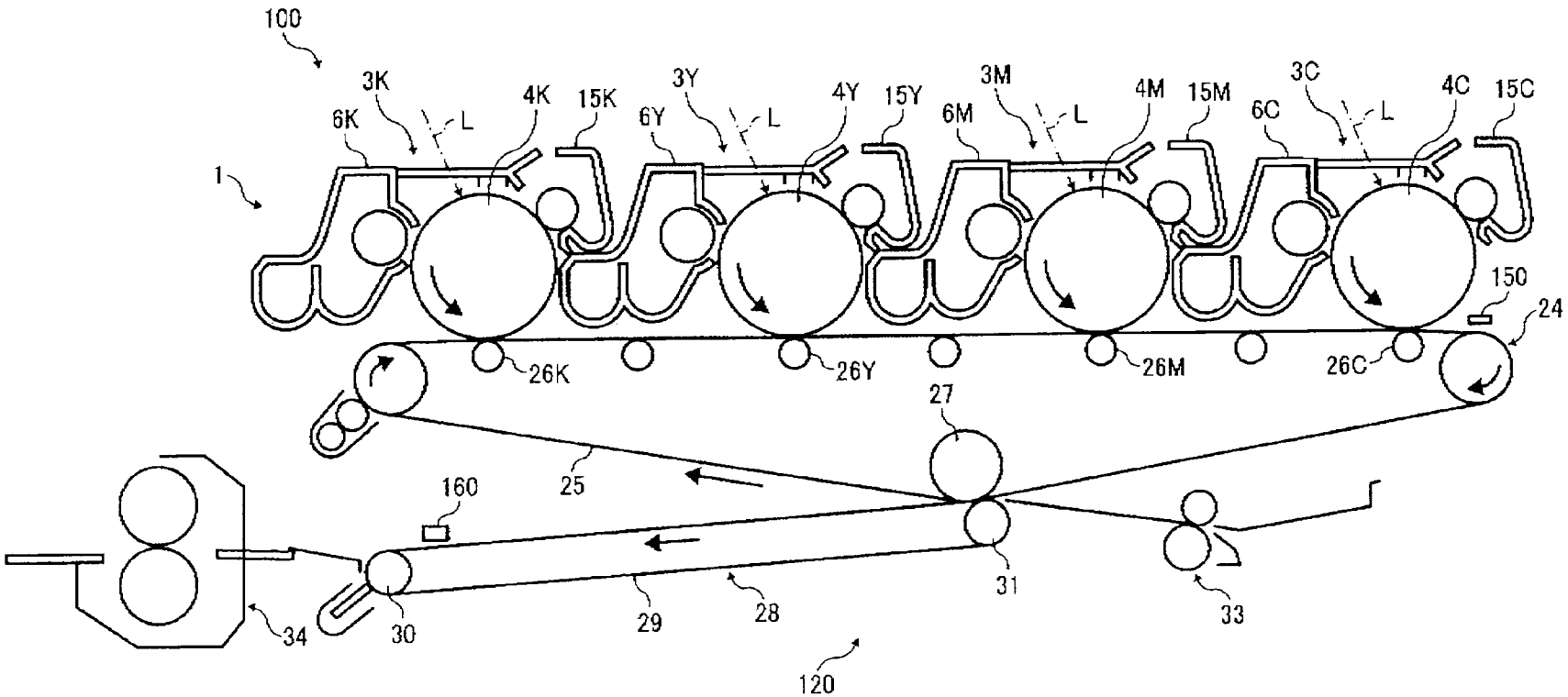
FIG. 2 is a partly enlarged view of an image forming mechanism in the image forming apparatus of FIG. 1.
Figure 3:
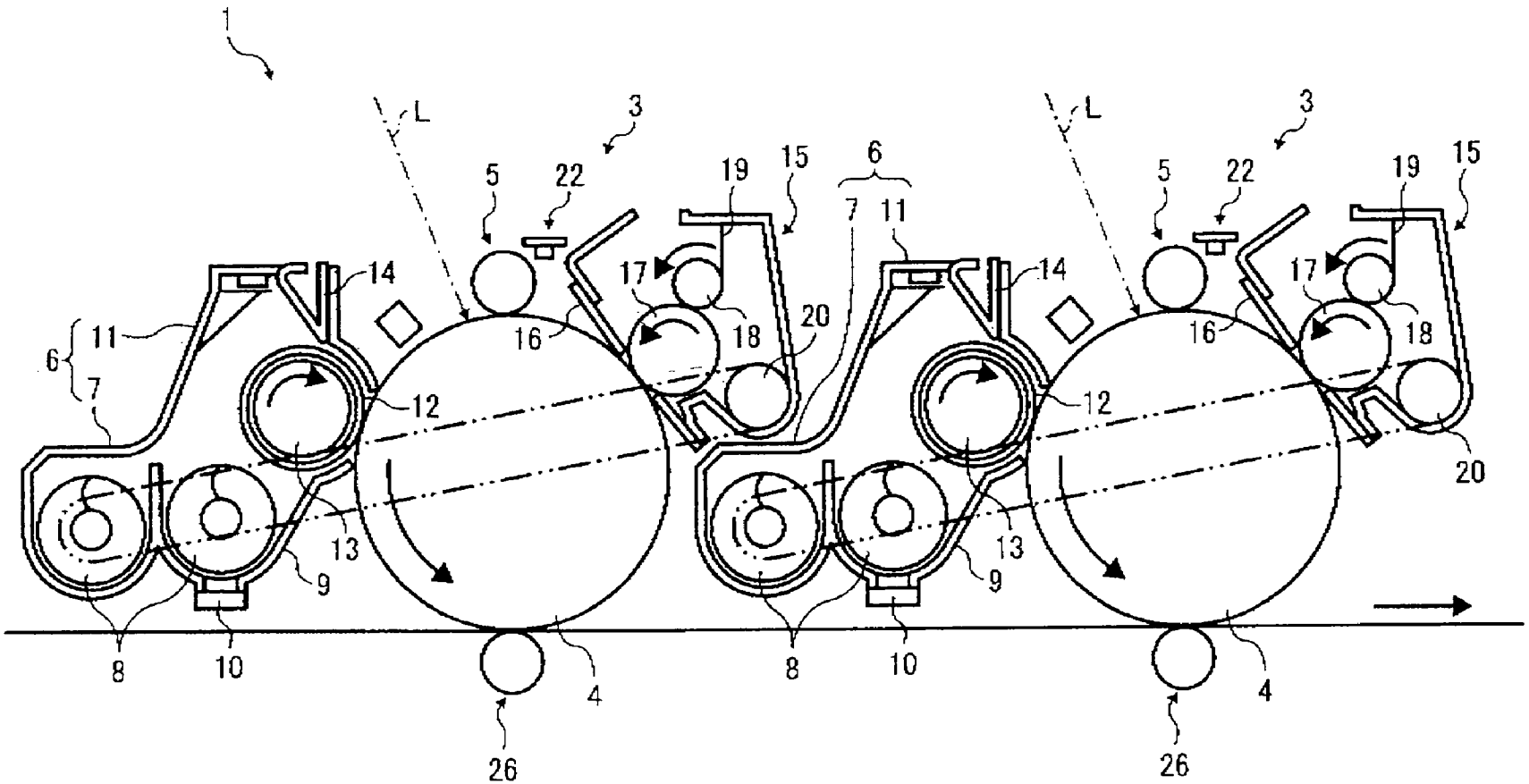
FIG. 3 is an enlarged view of any two adjacently disposed process units provided in the image forming mechanism of FIG. 2.

Referring to FIGS. 1 through 3, descriptions are given of an image forming apparatus 100 according to Exemplary Embodiment 1 of the present invention.

FIG. 1 shows a schematic configuration of the image forming apparatus 100. FIG. 2 is a partly enlarged view of an image forming mechanism included in the image forming apparatus 100 of FIG. 1. FIG. 3 is an enlarged view of any two adjacently disposed process units of multiple process units included in the image forming apparatus 100.

The image forming apparatus 100 can be any of a copier, a printer, a facsimile machine, a plotter, and a multifunction printer including at least one of copying, printing, scanning, plotter, and facsimile functions. In this non-limiting exemplary embodiment, the image forming apparatus 100 functions as a full-color copying machine or copier for electrophotographically forming a toner image based on image data on a recording medium (e.g., a transfer sheet).

The toner image is formed with four single toner colors, which are yellow, cyan, magenta, and black. Reference symbols "Y", "C", "M", and "K" represent yellow color, cyan color, magenta color, and black color, respectively.

In FIG. 1, the image forming apparatus 100 is a tandem-type electrophotographic image forming apparatus with an intermediate or indirect transfer method. The image forming apparatus 100 includes an image forming mechanism 1, a sheet feed device 40, and a document reading device 50.

The document reading device 50 includes a scanner 190 serving as an original reading unit and an automatic document feeder or ADF 51 supported by the scanner 190 and serving as an original document feeding unit.

The sheet feed device 40 includes a paper bank 41, two sheet feed cassettes 42 disposed at different height in the paper bank 41, sheet feed rollers 43 to feed a recording medium from the sheet feed cassettes 42, a sheet feed path 44, separation rollers 45 to separate the fed recording medium to convey to the sheet feed path 44, and multiple sheet conveyance rollers 46 to convey the recording medium fed from the sheet feed cassette 42 to a sheet feed path 37 provided in the image forming mechanism 1.

The image forming mechanism 1 includes an optical writing device 7, four process units 3Y, 3M, 3C, and 3K that form single-color toner images of yellow, magenta, cyan, and black, an image transfer unit 24, a transfer sheet conveyance unit 28, a pair of registration rollers 33, a fixing unit 34, a switchback unit 36, and the sheet feed path 37.

The optical writing device 7 includes optical source components such as laser diodes and LED, not shown, to emit respective laser light beams L toward four drum-shaped photoconductors 4Y, 4M, 4C, and 4K as shown in FIGS. 2 and 3. By irradiating the surfaces of the photoconductors 4Y, 4M, 4C, and 4K, respective electrostatic latent images are formed thereon and developed into corresponding toner images through a predetermined development process.

The process units 3Y, 3M, 3C, and 3K incorporate the photoconductors 4Y, 4M, 4C, and 4K, respectively, and image forming components disposed around each of the photoconductor 4Y, 4M, 4C, and 4K as a unit. Each of the process units 3Y, 3M, 3C, and 3K is detachably attachable to the image forming mechanism 1.

For example, the process unit 3K is provided for forming a black toner image and further includes a developing unit 6K (same as 6Y, 6M, and 6C, see FIG. 2) to develop the electrostatic latent image formed on the surface of the photoconductor 4K into a visible black toner image. The process unit 3K also includes a drum cleaning unit 15K (same as 15Y, 15M, and 15C, see FIG. 2) to clean the photoconductor 4K by removing residual toner remaining on the surface of the photoconductor 4K after passing a primary transfer nip for black toner or K-toner. A description of the primary transfer nip will be given later.

The image forming apparatus 100 according to the present invention employs a tandem-type configuration in which the four process units 3Y, 3M, 3C, and 3K are disposed facing an intermediate transfer belt 25 along a direction of movement of the intermediate transfer belt 25. A description of the intermediate transfer belt 25 will be described later.

FIG. 3 illustrates any two adjacently disposed process units of the process units 3Y, 3M, 3C, and 3K. Since the process units 3Y, 3M, 3C, and 3K have similar structures and functions, except that respective images of different single color toners are formed thereon, each of the process units 3Y, 3M, 3C, and 3K will be also referred to as a process unit 3. Further, the discussion below occasionally uses reference numerals without suffixes of colors such as Y, C, M, and K for specifying components of the image forming apparatus 100.

As shown in FIG. 3, the process unit 3 includes the photoconductor 4 and image forming components such as a charging unit 5, the developing unit 6, the drum cleaning unit 15, and a discharge lamp 22 disposed around the photoconductor 4.

The photoconductor 4 serves as an electrostatic latent image carrier, and includes a drum-shaped member having a layer coated by a photoconductive organic material on a tubular base member made of aluminum. Other than the drum-shaped photoconductor 4, a photoconductor of an endless belt can be applied.

The developing unit 6 uses two-component developer including magnetic carrier particles and non-magnetic toner particles, which are not shown, to develop the electrostatic latent image formed on the photoconductor 4 into a visible toner image. The developing unit 6 includes an agitation section 7, a development section 11, and a development sleeve 12.

The agitation section 7 agitates and conveys the two-component developer contained in the developing unit 6 to the development sleeve 12. The development section 11 transfers the toner particles of the two-component developer conveyed on the development sleeve 12 onto the photoconductor 4.

The agitation section 7 is disposed at a lower position than the development section 11 and includes two conveyance screws 8, a separator (not shown), a developer case 9, and a toner concentration sensor or T-sensor 10. The two conveyance screws 8 are disposed in a horizontal direction to each other. The separator is disposed between the two conveyance screws 8. The T-sensor 10 is disposed on a base surface of the developer case 9.

The development section 11 includes the development sleeve 12, a magnet roller 13, and a doctor blade 14.

The development sleeve 12 is disposed partly facing the photoconductor 4 through an opening of the developer case 9.

The magnet roller 13 is disposed inside the development sleeve 12 and is supported in a non-rotatable manner.

The doctor blade 14 is a non-magnetic and rotatable cylindrical member and is disposed such that the leading edge thereof faces the development sleeve 12 across a small gap.

The magnet roller 13 includes multiple magnets sequentially disposed across a direction of rotation of the development sleeve 12 from a position facing the doctor blade 14. These magnets magnetize the two-component developer on the development sleeve 12 at respective given positions in the direction of rotation of the development sleeve 12. This magnetization can attract the two-component developer from the agitation section 7 to the surface of the development sleeve 12 to form a magnetic brush on the development sleeve 12 along magnetic field lines.

The magnetic brush is conveyed as the development sleeve 12 rotates, regulated to an appropriate thickness or height when passing through a gap with respect to the doctor blade 14, and further conveyed to a development region facing the photoconductor 4. Then, by a potential difference between an electric potential of a developing bias applied to the development sleeve 12 and an electric potential of the electrostatic latent image formed on the photoconductor 4, the toner particles are transferred onto the electrostatic latent image and developed into a visible toner image. Further, the toner particles is returned to the development section 11 as the development sleeve 12 rotates, moved away from the surface of the development sleeve 12 affected by a repulsive magnetic field formed between magnetic poles of the magnet roller 13, and is conveyed back to the agitation section 7. In the agitation section 7, a toner supply unit, not shown, is driven based on detection results obtained by the toner concentration sensor 10 to supply a suitable amount of toner to the two-component developer. Alternative to the developing unit 6 containing the two-component developer, a developing unit 6 containing one-component developer including toner particles only can be applied.

The drum cleaning unit 15 includes a cleaning blade 16, a fur brush 17, an electric field roller 18, a scraper 19, and a collection screw 20.

The cleaning blade 16 includes polyurethane rubber material and is held in contact with the surface of the photoconductor 4. The cleaning blade 16 can be disposed facing the photoconductor 4 across a given gap.

The fur brush 17 is a conductive contact member disposed in contact with the photoconductor 4, and is rotatable in a direction indicated by arrows in FIG. 3, so as to enhance its cleaning ability. The fur brush 17 also functions to scrape a certain amount of lubricant from a solid lubricant, not shown, so as to apply the scraped lubricant that is reduced into fine powder to the surface of the photoconductor 4.

The electric field roller 18 includes metallic material and is disposed rotatable in a direction indicated by arrows in FIG. 3. The electric field roller 18 contacts the fur brush 17 in a counter manner to apply a bias to the fur brush 17 as it rotates, so that the toner adhering to the fur brush 17 is transferred onto the electric field roller 18.

The scraper 19 contacts its leading edge against the electric field roller 18 to scrape the toner transferred onto the electric field roller 18 from the electric field roller 18. The toner scraped by the scraper 19 then falls onto the collection screw 20.

The collection screw 20 conveys the collected toner toward an end of the drum cleaning unit 15 extending in a direction perpendicular to a drawing of FIG. 3. The toner is eventually conveyed to an external recycling unit 21, not shown. The external recycling unit 21 conveys the toner to the developing unit 6 for the purpose of recycling.

The discharge lamp 22 electrically discharges residual electric charge remaining on the surface of the photoconductor 4 by emitting light thereto. The discharged surface of the photoconductor 4 is uniformly charged by the charging unit 5 and irradiated by the optical writing device 7.

The charge unit 5 in this exemplary embodiment of the present invention includes a roller-type charge member or a charge roller that applies a charge bias to the photoconductor 4 by contacting against the photoconductor 4 while the charge roller rotates. However, instead of the above-described contact-type charge member, a non-contact-type charge member can be used. For example, a scorotron charger can charge the surface of the photoconductor 4 in a non-contact manner.

Through the above-described processes, yellow toner image, magenta toner image, cyan toner image, and black toner image are formed on the photoconductors 4Y, 4M, 4C, and 4K of the process units 3Y, 3M, 3C, and 3K, respectively.

As shown in FIG. 2, the image transfer unit 24 is located below the process units 3Y, 3M, 3C, and 3K. The image transfer unit 24 includes the intermediate transfer belt 25 that is spanned around and extended by multiple support rollers including a lower tension roller 27.

The intermediate transfer belt 25 rotates in an endless manner in a clockwise direction in FIG. 2 as indicated by arrows in the drawing while contacting the photoconductors 4Y, 4M, 4C, and 4K.

Primary transfer rollers 26Y, 26M, 26C, and 26K (indicated as 26 in FIG. 3) are disposed in contact with an inner loop of the intermediate transfer belt 25 and press against the photoconductors 4Y, 4M, 4C, and 4K, respectively, via the intermediate transfer belt 25, which forms respective primary transfer nip portions. Each of the primary transfer rollers 26Y, 26M, 26C, and 26K is applied with a primary transfer bias by a power source, not shown. The application of the primary transfer bias can form a primary transfer electric field in the primary transfer nip portion to electrostatically move a single-color toner image from each of the photoconductors 4Y, 4M, 4C, and 4K to the intermediate transfer belt 25.

As the intermediate transfer belt 25 rotates in the clockwise in FIG. 2, the single-color toner images are sequentially overlaid at the primary transfer nip portions to form a four-color toner image on an outer surface of the intermediate transfer belt 25. This action is occasionally referred to "primary transfer".

The transfer sheet conveyance unit 28 is located below the image transfer unit 24. The transfer sheet conveyance unit 28 serves as a transfer unit and includes a sheet conveyance belt 29, a drive roller 30, and a secondary transfer roller 31.

The sheet conveyance belt 29 is loop-shaped and spanned around and extended by the drive roller 30 and the secondary transfer roller 31. The sheet conveyance belt 29 is rotated in a direction indicated by an arrow in FIG. 2. The intermediate transfer belt 25 and the sheet conveyance belt 29 are sandwiched by the lower tension roller 27 of the image transfer unit 24 and the secondary transfer roller 31 of the transfer sheet conveyance unit 28. With this configuration, a secondary transfer nip portion is formed between the outer surface of the intermediate transfer belt 25 and the outer surface of the sheet conveyance belt 29.

A secondary transfer bias is applied to the secondary transfer roller 31 by a power source, not shown, while the lower tension roller 27 of the image transfer unit 24 is grounded. With this configuration, a secondary transfer electric field is formed at the secondary transfer nip portion.

The pair of registration rollers 33 is located on the right-hand side of the secondary transfer nip portion in FIG. 2. The pair of registration rollers 33 conveys a recording medium sandwiched between the rollers thereof toward the secondary transfer nip portion in synchronization with movement of the intermediate transfer belt 25 having the four-color toner image formed thereon.

In the secondary transfer nip portion, the four-color toner image formed on the intermediate transfer belt 25 is transferred onto the recording medium due to the secondary transfer electric field and a pressure force at the secondary transfer nip portion, and is developed into a full-color image. This action is occasionally referred to as "secondary transfer".

After passing through the secondary transfer nip portion, the recording medium having the full-color image is separated from the intermediate transfer belt 25 and is transported onto the outer surface of the sheet conveyance belt 29. As the sheet conveyance belt 29 rotates, the recording medium is conveyed to the fixing unit 34 while being held by the outer surface of the sheet conveyance belt 29.

After the intermediate transfer belt 25 have passed the secondary transfer nip portion, residual toner that has not been transferred to the recording medium at the secondary transfer nip portion remains on the surface of the intermediate transfer belt 25. The residual toner is scraped and removed from the intermediate transfer belt 25 by a belt cleaning unit disposed in contact with the intermediate transfer belt 25.

When the recording medium having the full-color toner image thereon is conveyed to the fixing unit 34, the fixing unit 34 fixes the full-color toner image by application of heat and pressure. The recording medium is then conveyed to a pair of discharging roller 35 and is finally discharged to an external unit of the image forming apparatus 100.

As shown in FIG. 1, the switchback unit 36 is located below the transfer sheet conveyance unit 28 and the fixing unit 34 in the image forming apparatus 100. When the recording medium having a full-color toner image on one side thereof is fixed in the fixing unit 34, the switchback unit 36 switches a path of the recording medium by a switching claw to a sheet reverse unit. The recording medium conveyed to the sheet reverse unit enters into the secondary transfer nip portion again. Another full-color toner image is formed on the other side of the recording medium in the secondary transfer nip portion, firmly fixed to the recording medium in the fixing unit 34, and is discharged to a sheet discharging tray.

The scanner 190 is fixed on the image forming mechanism 1 and includes a fixed reading member 191 and a movable reading member 192 as reading members to read an image of an original document D.

The fixed reading member 191 includes light sources, reflection mirrors, an image reading sensor such as a charge-coupled device or CCD and is disposed immediately below a first contact glass, not shown, which is fixedly provided on an upper wall of a casing of the scanner 190 so as to contact the original document D. When the original document D conveyed by the ADF 51 passes on the first contact glass, the fixed reading member 191 reflects the laser light beam emitted by a light source sequentially on the original document D and receives the reflected light by the image reading sensor via the multiple reflection mirrors. By so doing, the original document D can be scanned without moving optical components including the light sources and multiple reflection mirrors.

By contrast, the movable reading member 192 is disposed immediately below a second contact glass, not shown, which is fixedly provided on the upper wall of the casing of the scanner 190 so as to contact the original document D and is disposed on the right-hand side of the fixed reading member 191 in FIG. 1. The movable reading member 192 can move or shift the optical components such as the reflection mirrors in a horizontal direction. In the process of moving the optical components from the left-hand side to the right-hand side in FIG. 1, the movable reading member 192 causes a laser light beam emitted by the light source to reflect on an original document, not shown, placed on the second contact glass. An image reading sensor 193 that is fixedly mounted on the scanner 190 receives the reflected light via multiple reflection mirrors. Accordingly, the original document D can be scanned while moving the optical component.

The ADF 51 is disposed on the scanner 190 and includes a cover 52, a document tray 53, a document conveyance unit 54, and a document stacker 55. The document tray 53 is a member to which the original document D is placed before being scanned. The document conveyance unit 54 conveys the original document D. The document stacker 55 stacks the original document D after reading the original document D. The ADF 51 is rotatably supported in an upward and downward direction to the scanner 190 by a hinge 159, not shown, which is fixedly attached to the scanner 190. Operator opens and closes the ADF 51 swingably. With the ADF 51 open, the contact glass of the scanner 190 is exposed.

When binding a corner of document stack, the original documents D cannot be separated one by one, which cannot convey the original documents D on the ADF 51. Therefore, for a corner binding operation, the operator opens the ADF 51, places a target page of bound original documents D on a contact glass with a face down manner, and closes the ADF 51. Then, the movable reading member 192 of the scanner 190 shown in FIG. 1 is caused to scan the target page.

Alternatively, when scanning a document stack of multiple different original documents D, the fixed reading member 191 of the scanner 190 scans the accumulated original documents D while the accumulated original documents D are automatically conveyed one by one. In this case, after the document stack is set on the document tray 53, a start button for copying, not shown, is pressed. By pressing the start button, the ADF 51 conveys the original documents D of the document stack placed on the document tray 53 sequentially from an original document placed on top of the document stack, and conveys and reverses the fed original document to the document stacker 55. In the process of the transfer operation, the original document D is conveyed right above the fixed reading member 191 of the scanner 190 immediately after it is reversed. At this time, the fixed reading member 191 of the scanner 190 scans the image on the original document D.

Figure 4:
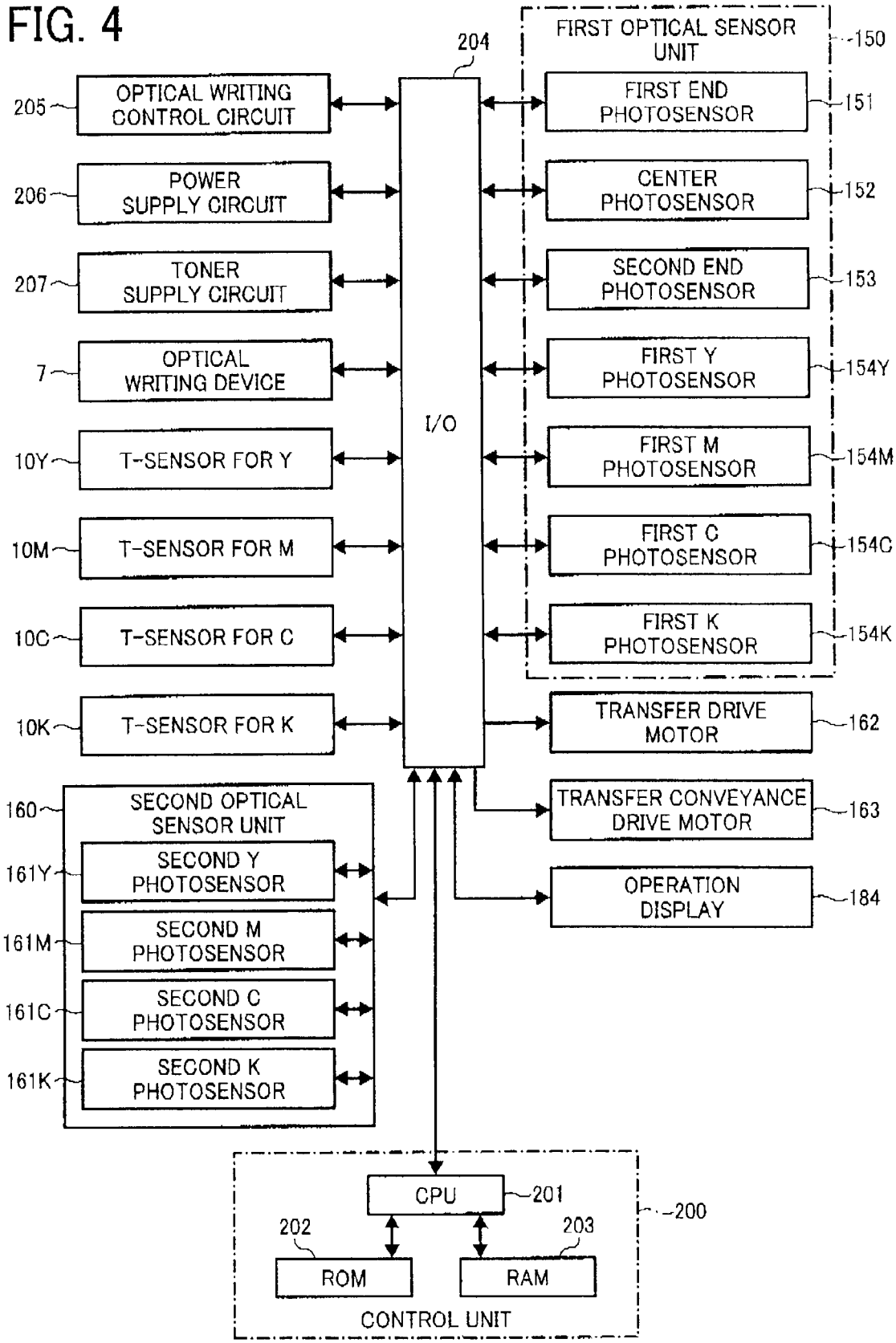
FIG. 4 is a block diagram showing a portion of electric circuits of the image forming apparatus of FIG. 1.

Referring to FIG. 4, a block diagram showing a portion of electric circuits of the image forming apparatus 100 according to Exemplary Embodiment 1 of the present invention is described.

In FIG. 4, the image forming apparatus 100 includes a first optical sensor unit 150, a second optical sensor unit 160, a control unit 200, and an input and output (I/O) interface 204.

The control unit 200 serving as a calculating unit for the operations of the image forming apparatus 100 includes a central processing unit (CPU) 201, a read only memory (ROM) 202 storing various control programs and data, and a random access memory (RAM) 203 temporarily storing the various data.

The I/O interface 204 receives and sends various signals with respect to the peripheral control units.

The control unit 200 is connected via the I/O interface 204 to the optical writing device 7, T-sensors 10Y, 10M, 10C, and 10K, an optical writing operation control circuit 205 that is dedicated to the controls of the optical writing device 7, a power supply circuit 206, and a toner supply circuit 207.

The T-sensors 10Y, 10M, 10C, and 10K detect respective toner concentrations in the developing units 6Y, 6M, 6C, and 6K, respectively.

The control unit 200 is also connected via the I/O interface 204 to a transfer drive motor 162 that is a source for driving the intermediate transfer belt 25, a transfer conveyance drive motor 163 that is a source for driving the sheet conveyance belt 29, and an operation display part 184 that includes a display and various key buttons.

The control unit 200 is further connected via the I/O interface 204 to the first optical sensor unit 150 and the second optical sensor unit 160.

The first optical sensor unit 150 includes a first end photosensor 151, a central photosensor 152, a second end photosensor 153, a first photosensor for yellow toner or a first Y-toner photosensor 154Y, a first photosensor for magenta toner or a first M-toner photosensor 154M, a first photosensor for cyan toner or a first C-toner photosensor 154C, and a first photosensor for black toner or a first K-toner photosensor 154K.

The second optical sensor unit 160 includes a second photosensor for yellow toner or a second Y-toner photosensor 161Y, a second photosensor for magenta toner or a second M-toner photosensor 161M, a second photosensor for cyan toner or a second C-toner photosensor 161C, and a second photosensor for black toner or a second K-toner photosensor 161K.

The first end photosensor 151, the central photosensor 152, the second end photosensor 153, the first toner photosensors 154Y, 154M, 154C, and 154K and the second toner photosensors 161Y, 161M, 161C, and 161K are reflective type photosensors that reflect light emitted from respective light emitting units, not shown, and detect the reflected light with respective light emitting units, not shown.

The optical writing operation control circuit 205 controls the optical writing device 7 based on instructions issued by the control unit 200 via the I/O interface 204.

The power supply circuit 206 applies a high voltage to the charging unit 5 of the process unit 6 based on instructions issued by the control unit 200 via the I/o interface 204, and applies a developing bias to the development section 11 of the developing unit 6.

The toner supply circuit 207 controls toner feeding units, not shown, based on instructions issued by the control unit 200 via the I/O interface 204, so as to control the amounts of toner replenished from the toner feeding units to the two-component developer contained in the corresponding developing units 6 (6Y, 6M, 6C, and 6K).

The control unit 200 sends instructions based on the output values output from the T-sensors 10Y, 10M, 10C, and 10K via the I/O interface 204 to the toner supply circuit 207. According to the instructions, the toner concentrations of the two-component developer accommodated in the respective developing units 6 may be kept in a reference toner concentration level.

Figure 5:
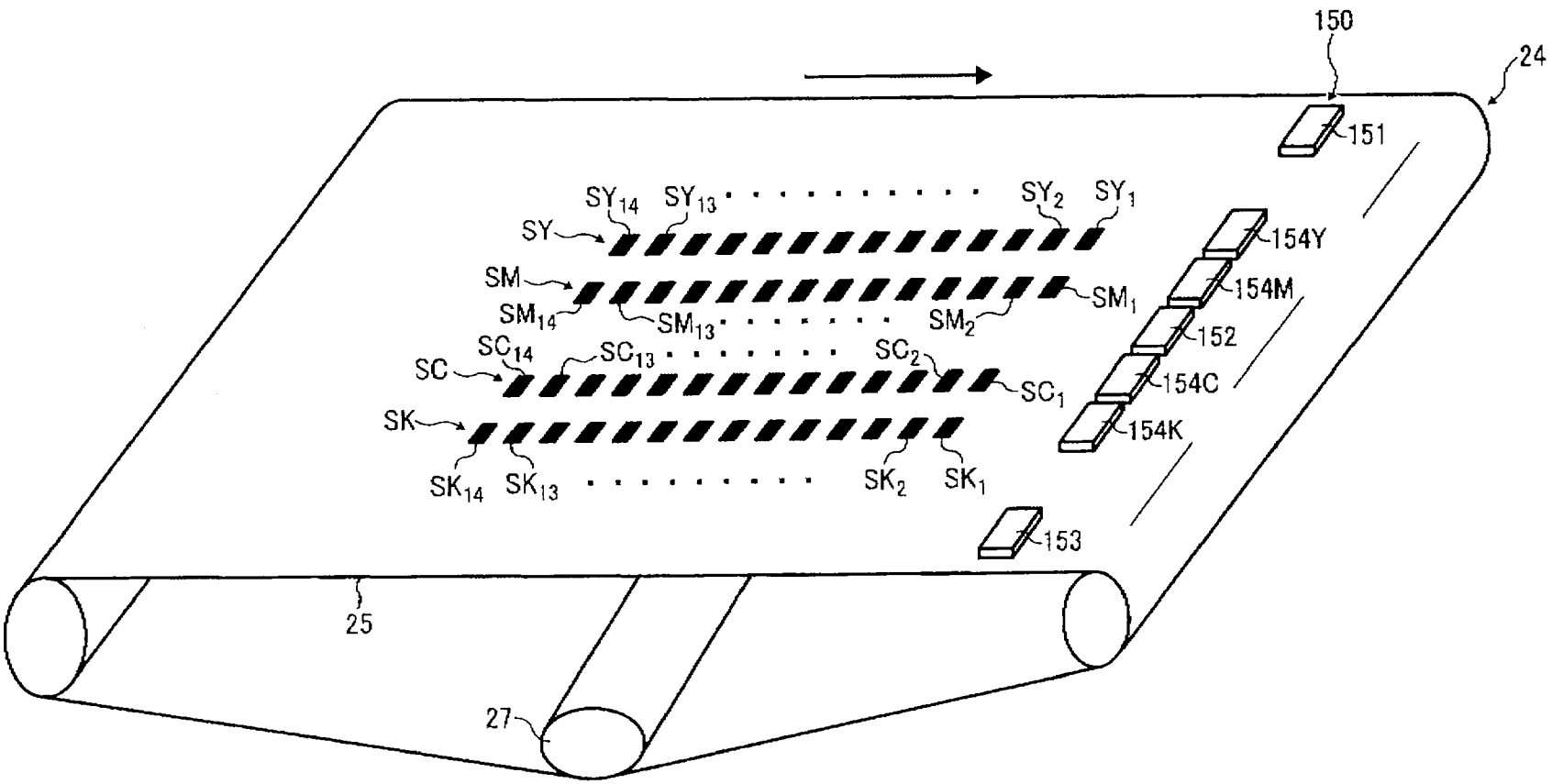
FIG. 5 is a schematic configuration of a transfer unit of the image forming apparatus of FIG. 1.

Referring to FIG. 5, a schematic configuration of the image transfer unit 24 including the intermediate transfer belt 25 with reference toner images formed thereon is described.

The image forming apparatus 100 is controlled to perform the following image forming condition adjusting operations at respective predetermined times or respective predetermined number of prints. More specifically, the image forming apparatus 100 can cause the optical writing operation control circuit 205 to control the optical writing device 7 based on instructions issued by the control unit 200 via the I/O interface 204.

The image forming apparatus 100 can also cause the control unit 200 to control the process units 3Y, 3M, 3C, and 3K and the image transfer unit 24. With the above-described controls, a group of reference toner images or a reference toner image group can be formed on the intermediate transfer belt 25 to detect image forming ability of the image forming apparatus 100. More specifically, the reference toner image group includes four reference toner image sets, which are a reference yellow toner image set SY, a reference magenta toner image set SM, a reference cyan toner image set SC, and a reference black toner image set SK. Each of the four reference toner image sets SY, SM, SC, and SK includes 14 reference toner images. The respective 14 reference toner images are formed by predetermined different pixel patterns having respective amounts of adhered toner different from each other.

As shown in FIG. 5, the reference yellow toner image set SY includes reference toner images SY1, SY2, . . . . SY13, and SY14, the reference magenta toner image set SM includes reference toner images SM1, SM2, . . . SM13, and SM14, the reference cyan toner image set SC includes reference toner images SC1, SC2, . . . . SC13, and SC14, and the reference black toner image set SK includes reference toner images SK1, SK2, . . . SK13, and SK14.

For example, the reference toner images SK 1, SK2, . . . SK13, and SK14 of the reference black toner image set SK have respective amounts of adhered toner that are gradually increased. The reference toner images SK 1, SK2, . . . SK13, and SK14 of the reference black toner image set SK are formed on the outer surface of the intermediate transfer belt 25 at predetermined intervals in a direction of movement of the loop-shaped intermediate transfer belt 25. The toner concentration of image or the respective amounts of adhered toner per unit area with respect to the reference toner images SK1, SK2, . . . SK13, and SK14 of the reference black toner image set SK are detected by the first K-toner photosensor 154K of the first optical sensor unit 150. The detection results are sent as an output value Vpi ("i" can be any of 1 to 14 corresponding to the reference toner images SK1, SK2, . . . SK13, and SK14) via the I/O interface 204 to the RAM 203 in which the detection results are stored.

For the first optical sensor unit 150, the photosensors of different toner colors are placed in a line across the width of the intermediate transfer belt 25. For example, the above-described reference black toner image set SK is located at the same distance as the position of the first K-toner photosensor 154K across the width of the outer surface of the intermediate transfer belt 25, and is detected by the first K-toner photosensor 154K as a result. Same as the reference black toner image set SK, the reference yellow toner image set SY, the reference magenta toner image set SM, and the reference cyan toner image set SC, each having 14 reference toner images, are located at the same distances as the respective positions of the first Y-toner photosensor 154Y, the first M-toner photosensor 154M, and the first C-toner photosensor 154C. Therefore, the reference black toner image set SK, the reference yellow toner image set SY, the reference magenta toner image set SM, and the reference cyan toner image set SC are detected by the first Y-toner photosensor 154Y, the first M-toner photosensor 154M, and the first C-toner photosensor 154C, respectively. Then, the output values Vp1 through Vp14 of the first Y-toner photosensor 154Y, the first M-toner photosensor 154M, and the first C-toner photosensor 154C, which are the detection results of the amounts of adhered toner per unit area with respect to the reference yellow, magenta, and cyan toner image sets SY, SM, and SC, are also sent via the I/O interface 204 to the RAM 203.

Based on the output values stored in the RAM 203 and a data table stored in the ROM 202, the control unit 200 calculates the output values to the corresponding amount of adhered toner per unit area and stores the calculation results as data of the amounts of adhered toner to the RAM 203.

Figure 6:
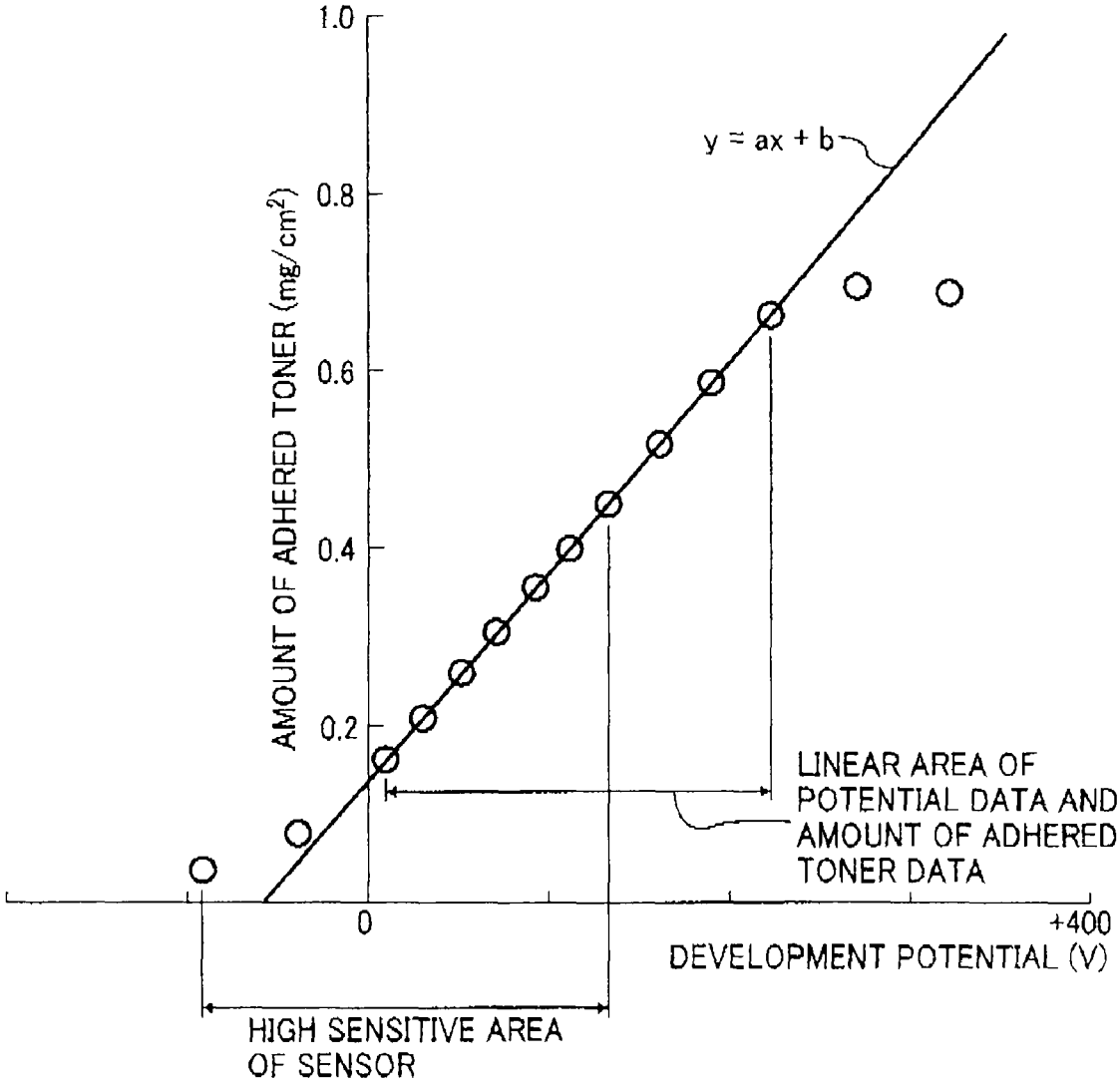
FIG. 6 is a graph showing a relation of potentials of photoconductors included in the image forming apparatus of FIG. 1.

Referring to FIG. 6, a graph showing a relationship of potentials of the photoconductors 4Y, 4M, 4C, and 4K of the image forming apparatus 100 and the corresponding amounts of toner adhered on the intermediate transfer belt 25 is described.

The graph of FIG. 6 has plotted the relationship in an x-coordinate and a y-coordinate. The x-coordinate represents a development potential (Unit: "V"), which is a difference between a developing bias voltage applied when the reference toner images on the intermediate transfer belt 25 are formed and a surface potential of each of the photoconductors 4Y, 4M, 4C, and 4K. The y-coordinate represents an amount of adhered toner per unit area (Unit: "mg/cm$^2$").

The control unit 200 refers to the development potential data and the toner amount data stored in the RAM 203, then selects, by each color of toner, an area in which the development characteristic or the relationship of the development potential data and the toner amount data forms a linear line, and performs a smoothing operation of the above-described data. After the smoothing operation has been performed, the control unit 200 applies a least squares method with respect to the smoothed data of the development potential data and the toner amount data to perform a collinear approximation of the development characteristic of each developing unit 6. Further, the control unit 200 obtains, for each color of toner, an equation of a straight line of the development characteristic of the developing unit 6. The equation is "y=ax+b". The control unit 200 then adjusts the image forming ability of each of the process units 3Y, 3M, 3C, and 3K based on an inclination "a" in the equation.

The image forming ability can be adjusted using a method adjusting the uniform charge potential of a photoconductor and a developing bias or another method adjusting the toner concentration of a two-component developer. This method is disclosed in Japanese Patent Laid-open Publication No. H9-211911.

As shown in FIG. 5, in the image forming condition adjusting operation, the reference yellow toner image set SY including the 14 reference toner images SY1, SY2, . . . SY13, and SY14 is formed in predetermined pitches in a moving direction or in a sub-scanning direction of the intermediate transfer belt 25. The reference magenta toner image set SM including the reference toner images SM1, SM2, . . . SM13, and SM14 is formed in predetermined pitches in the sub-scanning direction of the intermediate transfer belt 25 and in a main scanning direction of or in parallel with the reference yellow toner image set SY. The reference cyan toner image set SC including the reference toner images SC1, SC2, . . . SC13, and SC14 is formed in predetermined pitches in the sub-scanning direction of the intermediate transfer belt 25 and in a main scanning direction of or in parallel with the reference magenta toner image set SM. The reference black toner image set SK including the reference toner images SK1, SK2, . . . SK13, and SK14 is formed in predetermined pitches in the sub-scanning direction of the intermediate transfer belt 25 and in a main scanning direction of or in parallel with the reference cyan toner image set SC.

Figure 7:
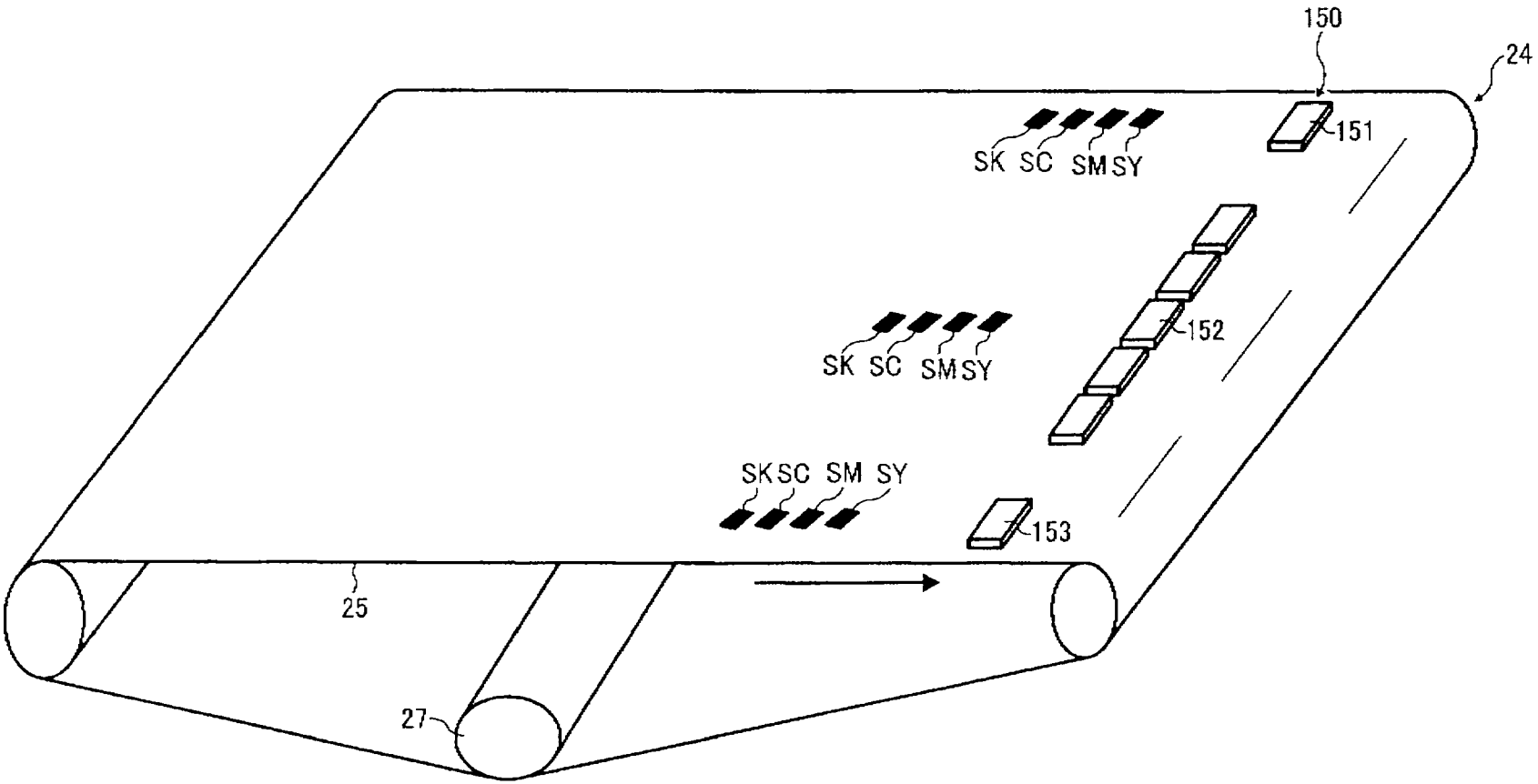
FIG. 7 is a schematic structure of an intermediate transfer belt included in the image forming apparatus of FIG. 1.

Referring to FIG. 7, a schematic structure of the intermediate transfer belt 25 having a different arrangement of patch patterns formed thereon is described.

The image forming apparatus 100 also has a function to perform a registration skew adjustment at a predetermined time. More specifically, after adjusting the developing bias, etc. with the above-described operation, the control unit 200 forms three sets of patch patterns for detecting registration skew at both ends and at the center of the intermediate transfer belt 25 along a widthwise direction of the intermediate transfer belt 25, as shown in FIG. 7. Each of the respective sets of patch patterns includes four reference yellow, magenta, cyan, and black toner image sets SY, SM, SC, and SK disposed in predetermined pitches in the sub-scanning direction of the intermediate transfer belt 25. The reference yellow, magenta, cyan, and black toner image sets SY, SM, SC, and SK are arranged to locate the respective reference toner images of the same color in a linear line in the main scanning direction.

In FIG. 7, the first end photosensor 151 detects the reference yellow, magenta, cyan, and black toner image sets SY, SM, SC, and SK of the patch pattern that is formed in the vicinity of the far side in the widthwise direction of the intermediate transfer belt 25. The central photosensor 152 detects the reference yellow, magenta, cyan, and black toner image sets SY, SM, SC, and SK of the patch pattern that is formed in the vicinity of the center portion in the widthwise direction of the intermediate transfer belt 25. The second end photosensor 153 detects the reference yellow, magenta, cyan, and black toner image sets SY, SM, SC, and SK of the patch pattern that is formed in the vicinity of the near side in the widthwise direction of the intermediate transfer belt 25.

When images of the reference yellow, magenta, cyan, and black toner image sets SY, SM, SC, and SK are formed at appropriate times to each other, the intervals of forming and detecting the images of the respective reference yellow, magenta, cyan, and black toner image sets SY, SM, SC, and SK may be equal. On the contrary, when the images of the reference yellow, magenta, cyan, and black toner image sets SY, SM, SC, and SK are not appropriate, the intervals of forming and detecting the images of the reference yellow, magenta, cyan, and black toner image sets SY, SM, SC, and SK cannot be equal.

Further, when the images of the reference yellow, magenta, cyan, and black toner image sets SY, SM, SC, and SK are optically written in an accurate manner, the images having the same color in the three sets of patch patterns should be detected simultaneously. However, when the images are askew, the detection times may be different from each other.

Thus, the control unit 200 adjusts the start time to optically write images to the photoconductors 4 by the optical writing device 7 according to deflection of intervals and times of the images of the reference yellow, magenta, cyan, and black toner image sets SY, SM, SC, and SK in the main scanning and sub-scanning directions and adjusts the respective angles of optical mirrors so that image shifts and skews on the toner images of each color can be prevented.

In the image forming apparatus 100, the control unit 200 serves as an image formation adjustment unit to perform an image formation adjustment process as described above, and the process units 3Y, 3M, 3C, and 3K, the optical writing device 7, and the image transfer unit 24 form an image forming mechanism 1 (see FIGS. 1 and 2). The image forming mechanism 1 forms a toner image on a recording medium.

Further, a combination of the image transfer unit 24 and the sheet conveyance unit 28 forms a transfer mechanism 120 (see FIGS. 1 and 2). In the transfer mechanism 120, after the toner image formed on the photoconductor 4 is transferred onto the intermediate transfer belt 25 that serves as a first endless belt, the toner image is transferred onto a recording medium conveyed on the surface of the sheet conveyance belt 29 that serves as a second endless belt.

Further, the photosensors 151, 152, 153, 154Y, 154M, 154C, and 154K of the first optical sensor unit 150 serve as a first detector that detects the toner image transferred onto a predetermined position on the surface of the intermediate transfer belt 25 and the concentration of the toner image.

As described above, the control unit 200 serves as the image formation adjustment unit that adjusts the charge potential uniformly charged on the surface of the photoconductor 4 and the developing bias that are image forming conditions related to the image forming density or concentration, based on the detection results obtained by the photosensors 151, 152, 153, 154Y, 154M, 154C, and 154K that serve as the first detector.

Further, the control unit 200 performs the image formation adjustment process for adjusting the start time of optical writing and the inclination of the optical mirrors which are conditions related to positioning of a toner image of each color on the surface of the intermediate transfer belt 25, based on the detection results obtained by the photosensors 151, 152, 153, 154Y, 154M, 154C, and 154K.

The first optical sensor unit 150 that serves as the first detector for an image formed on the intermediate transfer belt 25 is disposed at a given position. That is, the first optical sensor unit 150 is disposed to detect a toner image on the surface of the intermediate transfer belt 25 and positioned between the primary transfer nip portion at which the toner image is transferred from the photoconductor 4 onto the intermediate transfer belt 25 and the secondary transfer nip portion at which the toner image is transferred from the intermediate transfer belt 25 onto the recording medium conveyed on the sheet conveyance belt 29.

Next, a description is given of a characteristic structure of the image forming apparatus 100 according to Exemplary Embodiment 1 of the present invention.

The control unit 200 serves as a belt speed adjustment unit to perform a belt speed adjustment process for adjusting a speed of movement of the intermediate transfer belt 25 prior to the above-described image formation adjustment process.

In the belt speed adjustment process, the control unit 200 causes to form a scale pattern including multiple K-toner images arranged at predetermined pitches in a direction of movement of the intermediate transfer belt 25 along the entire circumference thereof. The first K-toner image photosensor 154K shown in FIG. 5 detects each K-toner image in the scale pattern. Based on the time intervals of detection of the K-toner images in the scale pattern, an average speed of movement of the intermediate transfer belt 25 per circumference thereof can be obtained. When the obtained average speed of movement of the intermediate transfer belt 25 is deviated from a predetermined regular speed, the setting of drive speed of the transfer drive motor 162 shown in FIG. 4 is changed so that the intermediate transfer belt 25 can be operated at the regular speed in the image forming operation after this adjustment. By so doing, even if environmental changes cause to change the diameter of a drive roller that drives the intermediate transfer belt 25 and/or the thickness of the intermediate transfer belt 25 and if the average speed of movement of the intermediate transfer belt 25 is deviated from the regular speed, the speed of movement of the intermediate transfer belt 25 can be adjusted to the regular speed.

After the belt speed adjustment process, the control unit 200 causes to form the K-toner image having a given reference size while no recording medium is fed, and applies the secondary transfer bias to the secondary transfer roller 31 shown in FIG. 2. Then, the scale pattern formed on the surface of the intermediate transfer belt 25 is transferred onto the sheet conveyance belt 29 as secondary transfer.

The second optical sensor unit 160 is disposed above the sheet transfer unit 28 as shown in FIG. 2 and includes the second Y-toner photosensor 161Y, the second M-toner photosensor 161M, the second C-toner photosensor 161C, and the second K-toner photosensor 161K as shown in FIG. 4. The above-described K-toner image having a reference size that is secondarily transferred onto the sheet conveyance belt 29 is detected by the second K-toner photosensor 161K.

The detection time period taken for detecting the K-toner image of reference size indicates how far the K-toner image is moved in a direction of movement of the sheet conveyance belt 29. When both the intermediate transfer belt 25 and the sheet conveyance belt 29 move at the respective regular speeds, the size of the K-toner image of reference size obtained based on the detection time period can be equal to a reference value. However, when the sheet conveyance belt 29 does not move at the regular speed due to environmental changes and therefore the speed of the sheet conveyance belt 29 is different from the speed of the intermediate transfer belt 25, the size of the K-toner image of reference size obtained based on the detection time period can be larger (longer) or smaller (shorter) than the reference value. Since the value different from the reference value depends on the average speed of movement of the sheet conveyance belt 29, the average value of the sheet conveyance belt 29 can be obtained based on the detection time period. Therefore, the control unit 200 obtains the average speed of movement of the sheet conveyance belt 29 based on the above-described detection time period and, when the result is deviated from the regular speed, the drive speed of the transfer conveyance drive motor 163 in FIG. 4 may be adjusted to the regular speed. By adjusting the speed of movement of the intermediate transfer belt 25 and the sheet conveyance belt 29 as described above, image distortion caused by the difference between the speed of movement of the intermediate transfer belt 25 and the speed of movement of the sheet conveyance belt 29 can be prevented in the image forming operation after this adjustment.

After the belt speed adjustment process, the control unit 200 performs the previously described image formation adjustment process. In the belt speed adjustment process, a process for adjusting the average speed of movement of the sheet conveyance belt 29 corresponds to the transfer adjustment process for adjusting the condition for secondary transfer performed by the transfer sheet conveyance unit 28. Therefore, the control unit 200 also serves as a transfer adjustment unit that adjusts transfer conditions such as the average speed of movement of the sheet conveyance belt 29, based on the detection results obtained by the second photosensors 161Y, 161M, 161C, and 161K of the second optical sensor unit 160 that serves as a second detector.

Further, the control unit 200 performs a secondary transfer bias adjustment process that corresponds to the transfer adjustment process while conducting the above-described image formation adjustment process. More specifically, the control unit 200 causes to transfer the four reference toner image sets SY, SM, SC, and SK from the intermediate transfer belt 25 onto the sheet conveyance belt 29, and the second photosensors 161Y, 161M, 161C, and 161K of the second optical sensor unit 160 detect the respective amounts of adhered toner per unit area with respect to the reference toner images of each reference toner image set. After the transfer rates of the above-described 14 reference toner images in each reference toner image set are obtained based on the comparison with the amounts of adhered toner per unit area detected by the first optical sensor unit 150, the average value of respective transfer rates of the 14 reference toner images is obtained. Then, the secondary transfer bias corresponding to the above-described average value is specified according to a data table stored in the ROM 202 indicating the relation of the transfer rates of the reference toner images and the corresponding appropriate secondary transfer bias, and set the secondary transfer bias to the specific value for the subsequent image forming operation.

Specifically, the control unit 200 also serves as the transfer adjustment unit that adjusts the secondary transfer bias as a transfer condition, based on the transfer rate of the toner image. The secondary transfer bias adjustment process can prevent secondary transfer failure caused by inappropriateness of the secondary transfer bias due to environmental changes.

The second Y-toner photosensor 161Y, the second M-toner photosensor 161M, and the second C-toner photosensor 161C of the second optical sensor unit 160 are multi-reflective photosensors that can receive both specular and diffuse reflection light. The reason why the multi-reflective photosensor is employed is described below. That is, if a specular reflection photosensor is used when an amount of adhered toner per unit area with respect to the reference toner images of Y-toner, M-toner, and C-toner is detected, the detection accuracy of the amount of adhered toner becomes lower as the amount of adhered toner relatively increases. By contrast, if a diffuse reflection photosensor is used, the detection accuracy of the amount of adhered toner becomes higher as the amount of adhered toner relatively decreases. As long as the transfer rates of toner images during the primary transfer and the secondary transfer are not reduced significantly, the amount of adhered toner per unit area with respect to the reference toner images transferred onto the sheet conveyance belt 29 can be relatively large, and therefore the diffuse reflection photosensor is suitable.

However, when the transfer rate of the toner images during the primary transfer and the secondary transfer is significantly reduced due to great environmental changes, the amount of adhered toner with respect to the reference toner images transferred onto the sheet conveyance belt 29 may be relatively small. In such a case, by detecting the amount of adhered toner with accuracy, the secondary transfer bias can be adjusted more appropriately.

By contrast, the first Y-toner photosensor 154Y, the first M-toner photosensor 154M, and the first C-toner photosensor 154C of the first optical sensor unit 150 are diffuse reflection photosensors. The transfer rate in the primary transfer is not affected by a decrease in transfer rate of the toner images in the secondary transfer, and the amount of adhered toner per unit area of the reference toner images formed on the intermediate transfer belt 25 may not be relatively small. Therefore, the diffuse reflection photosensor can be used to reduce the amount of adhered toner per unit area with respect to the reference toner images. Accordingly, the detection accuracy of the amount of adhered toner in the first optical sensor unit 150 may not be degraded and can achieve low cost, compared when the first optical sensor unit 150 uses the multi-reflective photosensor.

Exemplary Embodiment 2

Figure 8:
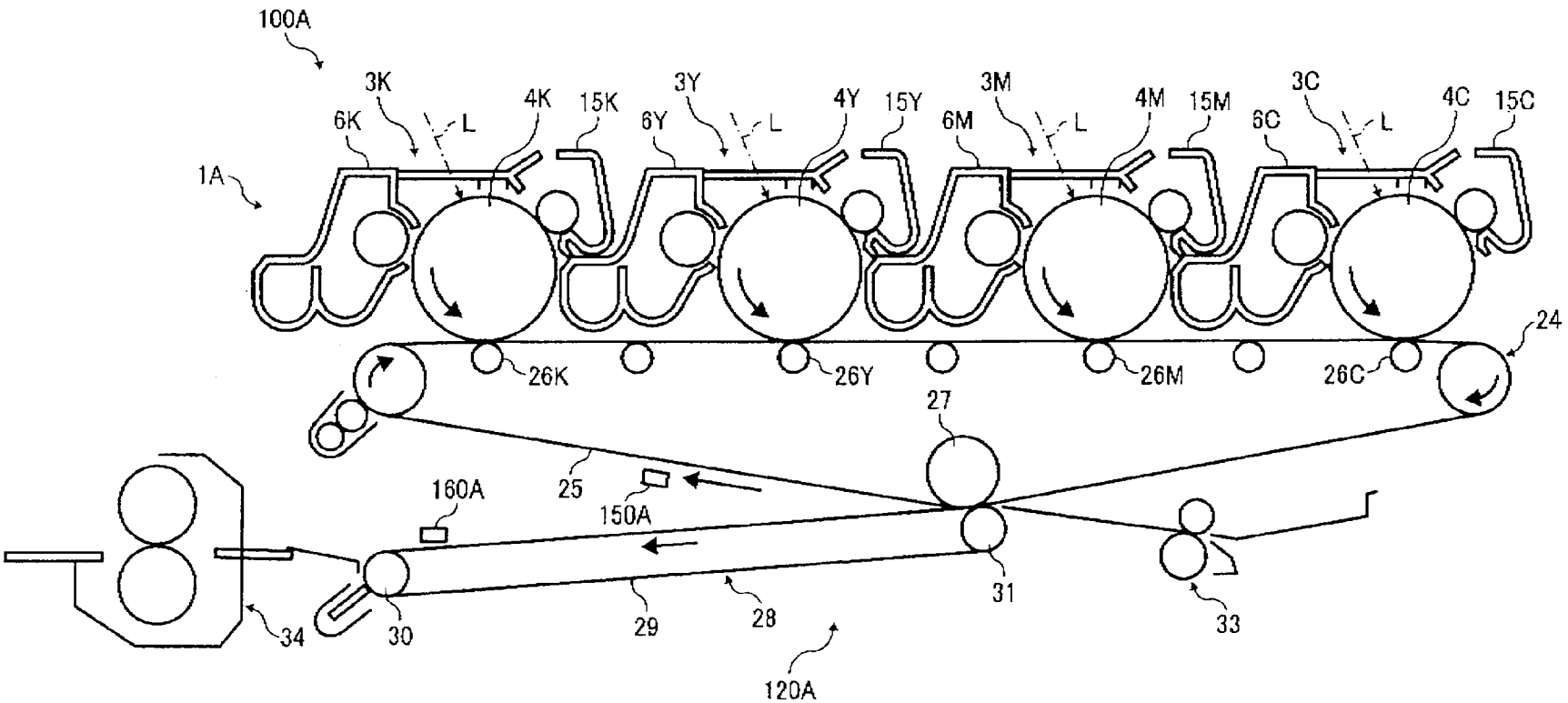
FIG. 8 is a partly enlarged view of an image forming mechanism in an image forming apparatus according to Exemplary Embodiment 2 of the present invention.
Figure 9:
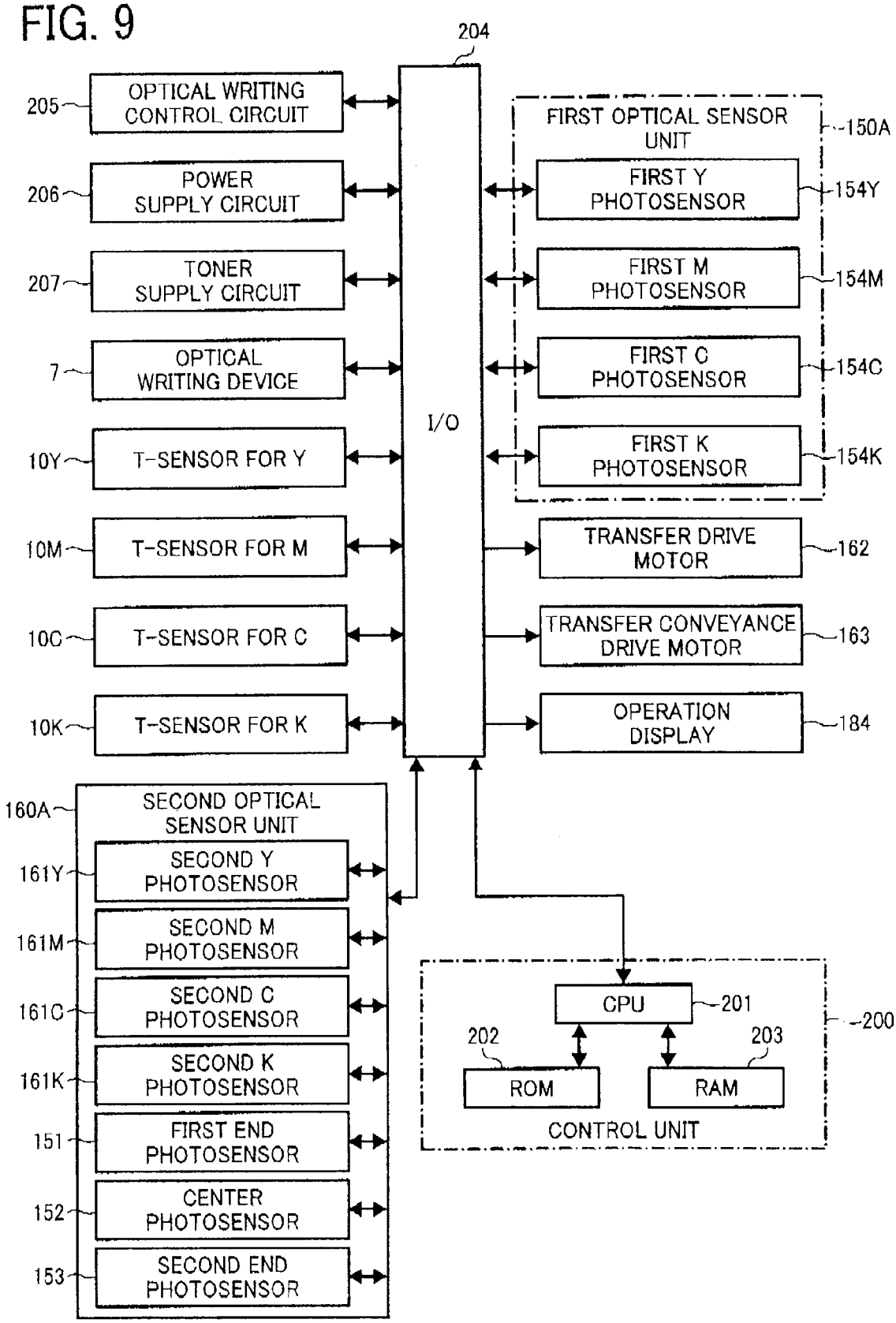
FIG. 9 is a block diagram showing a portion of electric circuits of the image forming apparatus according to Exemplary Embodiment 2 of the present invention.

Next, referring to FIGS. 8 and 9, descriptions are given of an image forming apparatus 100A (FIGS. 1 and 8) according to Exemplary Embodiment 2 of the present invention.

Elements or components of the electric circuits of the image forming apparatus 100A according to Exemplary Embodiment 2 may be denoted by the same reference numerals as those of the image forming apparatus 100 according to Exemplary Embodiment 1 and the descriptions thereof are omitted or summarized.

FIG. 8 is a partial enlarged view indicating an internal configuration of an image forming mechanism 1A (also see FIG. 1) of the image forming apparatus 100A according to Exemplary Embodiment 2 of the present invention.

In the image forming apparatus 100A, the process units 3Y, 3M, 3C, and 3K, the optical writing device 7, and the image transfer unit 24 form an image forming mechanism 1A (see FIGS. 1 and 8). The image forming mechanism 1A forms a toner image on a recording medium.

Further, a combination of the image transfer unit 24 and the sheet conveyance unit 28 forms a transfer mechanism 120A (see FIGS. 1 and 8). In the transfer mechanism 120A, after the toner image formed on the photoconductor 4 is transferred onto the intermediate transfer belt 25 that serves as a first endless belt, the toner image is transferred onto a recording medium conveyed on the surface of the sheet conveyance belt 29 that serves as a second endless belt.

In FIG. 8, the image forming apparatus 100A includes a first optical sensor unit 150A disposed downstream from the secondary transfer nip portion in an operational region of the intermediate transfer belt 25, so as to detect the toner images. Due to limitation in layout, the first optical sensor unit 150 cannot be disposed upstream from the secondary transfer nip. In this case, it is general to provide a separation and contact mechanism, not shown, which separates and contacts the sheet conveyance belt 29 with respect to the intermediate transfer belt 25 at the secondary transfer nip portion. The separate and contact mechanism causes the sheet conveyance belt 29 to be separated from the intermediate transfer belt 25 in the image formation adjustment process. By so doing, the toner adhering to the reference patch patterns or the above-described patch patterns formed on the intermediate transfer belt 25 cannot be transferred onto the sheet conveyance belt 29. However, additional installation of the separation and contact mechanism can cause an increase in cost.

Therefore, the image forming apparatus 100A is controlled to perform the belt speed adjustment process and the image formation adjustment process without providing the separation and contact mechanism thereto. More specifically, as shown in FIG. 9, the first optical sensor unit 150A includes the first toner photosensors 154Y, 154M, 154C, and 154K of respective colors shown in FIG. 5 and does not employ the first end photosensor 151, the center photosensor 152, and the second end photosensor 153. Instead, the image forming apparatus 100A includes a second optical sensor unit 160A that includes the first end photosensor 151, the center photosensor 152, the second end photosensor 153, and the second toner photosensors 161Y, 161M, 161C, and 161K, as shown in FIG. 9. The second optical sensor unit 160A serves as a belt image detector.

In the image forming apparatus 100A, the belt speed adjustment unit and the image formation adjustment unit perform the belt speed adjustment process and the image formation adjustment process, respectively, to transfer the toner images from the intermediate transfer belt 25 onto the sheet conveyance belt 29, and the photosensors 151, 152, 153, 161Y, 161M, 161C, and 161K of the second optical sensor unit 160A detects the toner images.

The four photosensors 154Y, 154M, 154C, and 154K of the first optical sensor unit 150A detect respective residual images of the pattern images that have passed the secondary transfer nip portion and respective amounts of toner adhered to the residual images remaining on the intermediate transfer belt 25. That is, the four photosensors 154Y, 154M, 154C, and 154K of the first optical sensor unit 150A serve as respective residual image detectors, each of which detects residual images remaining on the intermediate transfer belt 25 and the concentration of the residual images after passing the secondary transfer nip portion.

The control unit 200 performs the belt speed adjustment process to obtain the average speed of movement of the intermediate transfer belt 25 based on the intervals of detection time of each residual image. Further, the control unit 200 performs the image formation adjustment process to add the amount of toner adhered to the residual toner of each reference toner image and the amount of toner adhered to each reference toner image based on the detection results of the photosensor of the second optical sensor unit 160A. The added value is regarded as the amount of toner attached to each reference toner image on the intermediate transfer belt 25. Further, in the image formation adjustment process performed by the control unit 200, the start time of optical writing and the inclination of the optical mirrors are adjusted based on the detection results of each patch pattern in FIG. 7 obtained by the photosensors 151, 152, 153, 161Y, 161M, 161C, and 161K of the second optical sensor unit 160A.

In the above-described configuration, the detection accuracy may not be reduced and the amount of adhered toner and the detection time intervals can be detected with accuracy even without the separation and contact mechanism.

The four photosensors 154Y, 154M, 154C, and 154K of the first optical sensor unit 150A are specular reflection photosensors. Since the amount of toner adhered to the residual image is relatively small, the specular reflection photosensor is suitable to detect the relatively small amount of adhered toner with accuracy.

Although the optical sensors described above are generally reflective photosensors that detect the amount of reflected light, exemplary embodiments of the present invention are not intended to be limited to this configuration. For example, a transmissive photosensor that detects the amount of transmitted light with respect to the intermediate transfer belt 25 can be used. Even with the transmissive photosensor, the toner image can be detected and the amount of adhered toner can be obtained by detecting light transmission rate that is an optical characteristic of the intermediate transfer belt 25 instead of detecting light reflection rate on the surface of the intermediate transfer belt 25. In this case, the intermediate transfer belt 25 includes light transmissive material for a detection target part.

Further, although the image forming apparatuses 100 and 100A transfer a toner image formed on the intermediate transfer belt 25 onto a recording medium conveyed on the sheet conveyance belt 29 in the secondary transfer nip portion (secondary transfer), exemplary embodiments of the prevent invention are not intended to be limited to this configuration. For example, the present invention is applicable to an image forming apparatus employing a configuration in which a toner image is transferred directly onto the surface of a second intermediate transfer belt. Such a configuration of an image forming apparatus is disclosed in Japanese Patent Laid-open Publication No. 2002-197274, for example.

Further, an encoder serving as a belt speed detector can be provided to a driven roller that rotates with the intermediate transfer belt 25. According to the detection results obtained by the encoder, the control unit 200 can adjust the speed of movement of the intermediate transfer belt 25.

Further, the intermediate transfer belt 25 can include a scale at end portion in a widthwise direction on the surface thereof and can further include a scale detector that serves as the belt speed detector and detects the marks in the scale. With this configuration, the control unit 200 can adjust the speed of movement of the intermediate transfer belt 25 according to the detection results obtained by the scale detector.

Exemplary Embodiment 3

Figure 10:
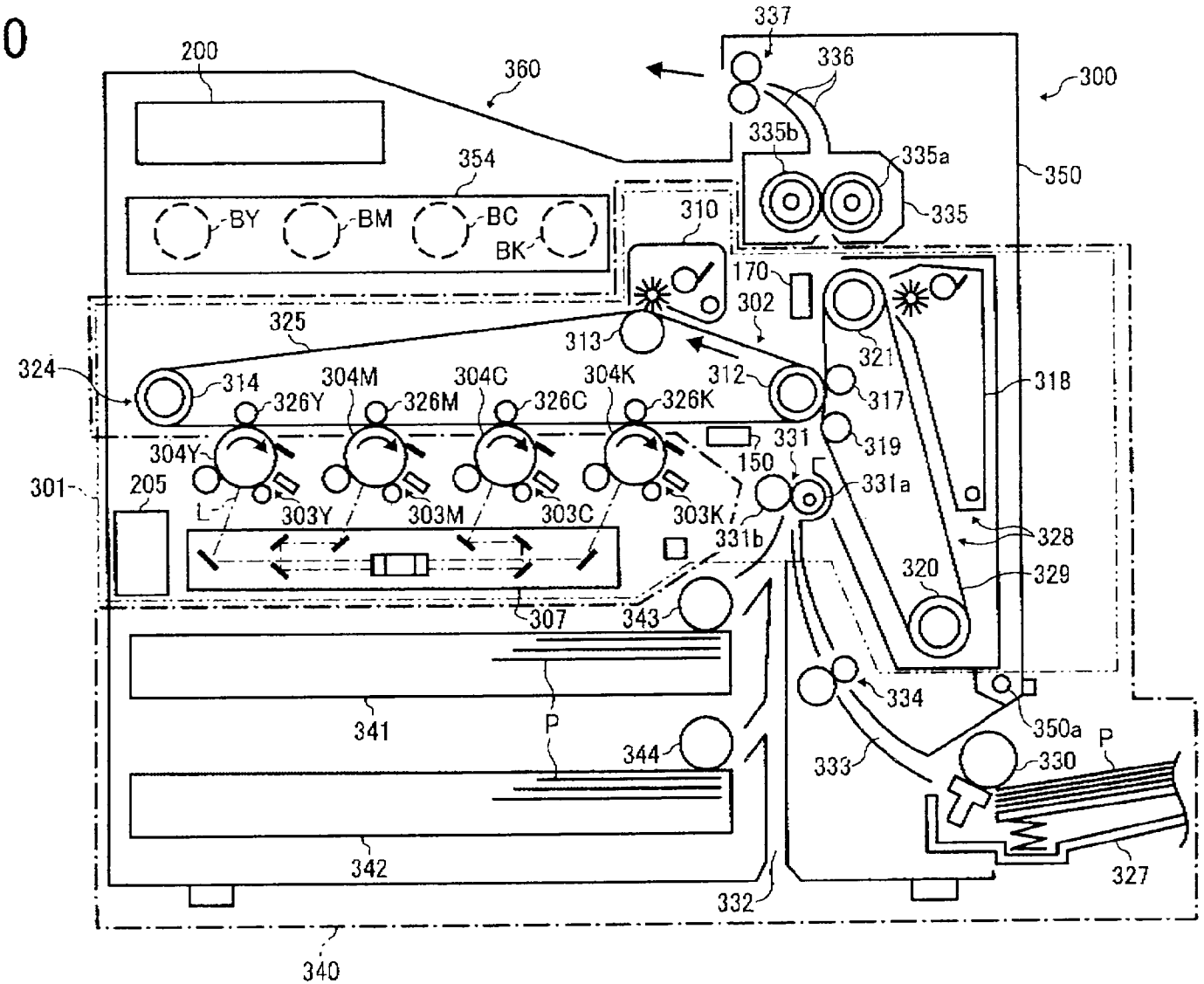
FIG. 10 is a schematic configuration of an image forming apparatus according to Exemplary Embodiment 3 of the present invention.
Figure 11:
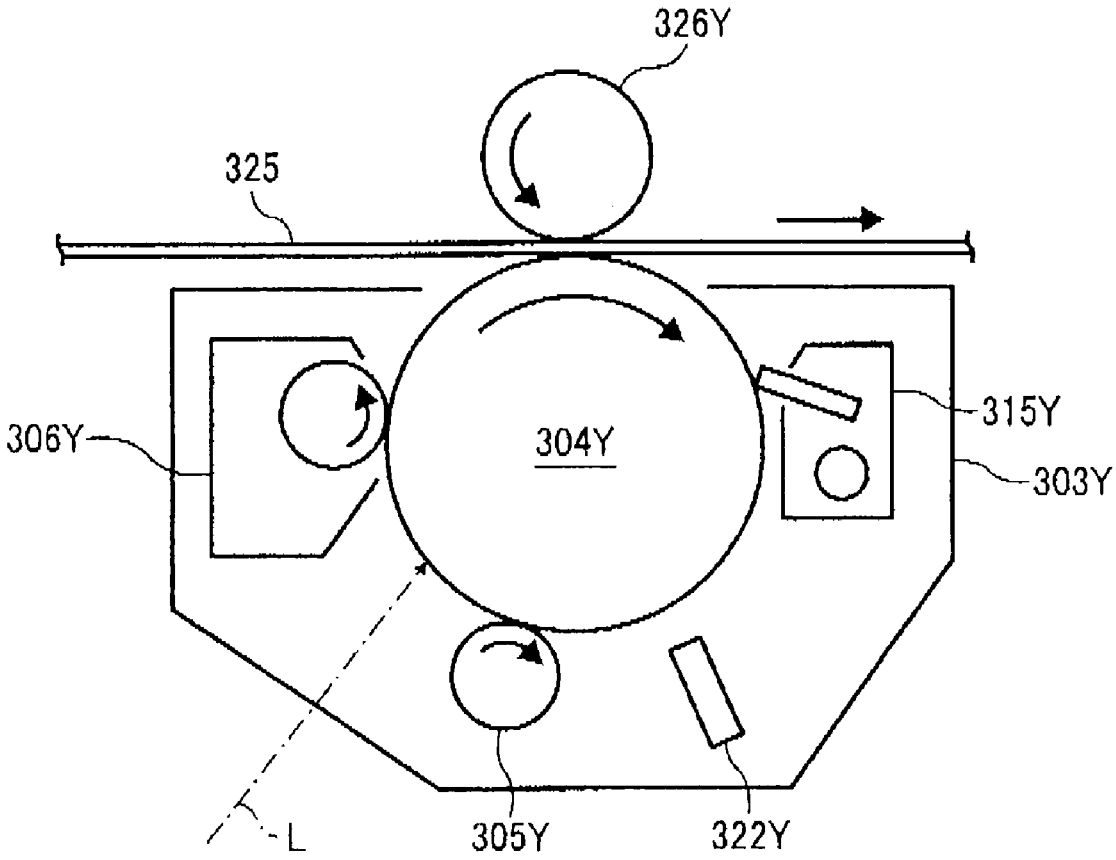
FIG. 11 is a partly enlarged view of a process unit of the image forming apparatus of FIG. 10.

Next, referring to FIGS. 10 and 11, descriptions are given of an image forming apparatus 300 according to Exemplary Embodiment 3 of the present invention.

In this non-limiting exemplary embodiment, the image forming apparatus 300 functions as a full-color printing machine or printer for electrophotographically forming a toner image based on image data on a recording medium (e.g., a transfer sheet).

FIG. 10 is a front view illustrating a schematic configuration of the image forming apparatus 300, and FIG. 11 is a partly enlarged view of a process unit 303 of the image forming apparatus 300 of FIG. 10.

As shown in FIG. 10, the image forming apparatus 300 includes four process units 303Y, 303M, 303C, and 303K, an optical writing device 307, a fixing unit 335, and a transfer device 340.

The process units 303Y, 303M, 303C, and 303K form toner images with four single toner colors, which are yellow, cyan, magenta, and black. Reference symbols "Y", "C", "M", and "K" represent yellow color, cyan color, magenta color, and black color, respectively. Each of the process units 303Y, 303M, 303C, and 303K can be replaced at the end of its life.

Since the process units 303Y, 303M, 303C, and 303K have similar structures and functions, except that respective images of different single color toners are formed thereon. Further, the discussion below occasionally uses reference numerals without suffixes of colors such as Y, C, M, and K for specifying components of the image forming apparatus 300.

For example, the process unit 303Y for yellow toner images includes a photoconductor 304Y (same as 304M, 304C, and 304K, see FIG. 10), a drum cleaning unit 315Y (see FIG. 11), a discharging unit 322Y, a charging unit 305Y, and a developing unit 306Y.

The photoconductor 304Y is drum-shaped and serves as an image carrier. In Exemplary Embodiment 3 of the present invention, the photoconductor 304Y is an aluminum cylindrical member and is covered by a surface member with an organic semiconductor having a photoconductive material. However, the exemplary embodiments of the present invention are not intended to be limited to this configuration. For example, the photoconductor 304Y of the present invention may be covered by a surface member including an amorphous silicon resin. Further, the photoconductor 304Y may be an endless belt member.

The charging unit 305Y includes a charge member that is rotated by a drive unit, not shown, in a clockwise direction in FIG. 11 to uniformly charge the surface of the photoconductor 304Y. The uniformly charged surface of the photoconductor 304Y is then exposed by a laser light beam L to form an electrostatic latent image for yellow color.

The developing unit 306Y develops the electrostatic latent image into a visible yellow toner image before being transferred onto an intermediate transfer belt 325 (see FIGS. 10 and 11), which will be described later.

The drum cleaning unit 315Y cleans the surface of the photoconductor 304Y by removing residual toner remaining on the photoconductor 304Y.

The discharging unit 322Y electrically discharges residual electric charge remaining on the surface of the photoconductor 304Y after cleaning by emitting light thereto. By discharging the surface of the photoconductor 304Y, the surface thereof is electrically initialized for a subsequent image forming operation.

As previously described, the process units 303Y, 303M, 303C, and 303K have similar structures and functions, and therefore the above-described operations performed for the process unit 303Y are also performed for the process units 303M, 303C, and 303K.

Developer contained in each of the developing units 306Y, 306M, 306C, and 306K can be either one-component developer including toner particles only or two-component developer including toner particles and magnetic carrier particles.

In FIG. 10, the optical writing device 307 is disposed below the process units 303Y, 303M, 303C, and 303K, and an optical writing operation control circuit 205 is disposed on the left-hand side of the optical writing device 307.

The optical writing operation control circuit 205 generates an optical writing control signal based on image data transmitted from an external personal computer and sends the optical writing control signal to the optical writing device 307.

The optical writing device 307 serves as a latent image writing unit to emit the laser light beam L (see FIG. 11) generated based on the optical writing control signal to the photoconductor 304 of each of the process units 303Y, 303M, 303C, and 303K. With this emission of the laser light beam L, an electrostatic latent image on the surface of the photoconductor 304. That is, respective electrostatic latent images for yellow, magenta, cyan, and black toners are formed on the photoconductors 304Y, 304M, 304C, and 304K.

The optical writing device 307 described above emits the laser light beam L that is generated by a light source, scans the laser light beam L by a polygon mirror that is rotated by a motor, and irradiate the surface of the photoconductor 304 via multiple optical lenses and mirrors. However, instead of the above-described optical writing device 307, the present invention can be applied to an optical writing device that emits light of a light-emitting diode or LED from a LED array.

Next, the transfer device 340 performs a transfer operation to the electrostatic latent images formed on the photoconductors 304Y, 304M, 304C, and 304K.

The transfer device 340 includes a first sheet feed cassette 341, a second sheet feed cassette 342, a manual sheet feed tray 327, and a sheet feed unit that serves as a recording medium conveyance unit, and a transfer unit 302.

The first sheet feed cassette 341, the second sheet feed cassette 342, and the manual sheet feed tray 327 of the transfer device 340 serve as a recording medium accommodating unit. The first sheet feed cassette 341 and the second sheet feed cassette 342 are placed to be overlapped in a vertical direction below the optical writing device 307 in FIG. 10, and each accommodates a stack of multiple recording media including a recording medium P.

By contrast, the manual sheet feed tray 327 extends from a side of a frame of the image forming apparatus 300 to accommodate a stack of multiple recording media including the recording medium P thereon.

The sheet feed unit of the transfer device 340 includes a first sheet feed roller 343, a second sheet feed roller 344, a manual sheet feed roller 330, a pair of registration rollers 331, a sheet feed path 332, a sheet feed guide path 333 that meets the sheet feed path 332, and a pair of conveyance rollers 334.

The first sheet feed roller 343 and the second sheet feed roller 344 are held in contact with the recording medium P atop the stack of recording media accommodated in the first sheet feed cassette 341 and the second sheet feed cassette 342, respectively. When respective drive units, not shown, rotate the first sheet feed roller 343 and the second sheet feed roller 344, the recording medium P is fed toward the sheet feed path 332.

The fed recording medium P is stopped and held between a first registration roller 331*a* and a second registration roller 331*b* of a pair of registration rollers 331 that is disposed at an upper end of the sheet feed path 332.

The pair of registration rollers 331, which serves as a pair of timing rollers, rotates the first registration roller 331*a* and the second registration roller 331*b* in a forward direction and stops rotating the rollers 331*a* and 331*b* when the recording medium P is held therebetween. Then, in synchronization with movement of the intermediate transfer belt 325, the pair of registration rollers 331 starts rotating the rollers 331*a* and 331*b* again to convey the recording medium P toward a secondary transfer nip portion, which will be described later.

By contrast, the manual sheet feed roller 330 is held in contact with the recording medium P atop the stack of recording media placed on the manual sheet feed tray 327. When a drive unit, not shown, rotates the manual sheet feed roller 330, the recording medium P is fed toward the sheet feed guide path 333.

The recording medium P fed from the manual sheet feed tray 327 is conveyed to a pair of conveyance rollers 334. The pair of conveyance rollers 334 includes rollers that are held in contact with each other and rotated by a drive unit, not shown, in a forward direction. The rollers of the pair of conveyance rollers 334 hold the recording medium P therebetween and convey the recording medium P toward the upper end of the sheet feed path 332, where the recording medium P is sandwiched by the first registration roller 331*a* and the second registration roller 331*b* of the pair of registration rollers 331.

The transfer unit 302 of the transfer device 340 includes a first transfer unit 324 and a second transfer unit 328.

The first transfer unit 324 is disposed above the process units 303Y, 303M, 303C, and 303K in FIG. 10, and includes the intermediate transfer belt 325, four primary transfer rollers 326Y, 326M, 326C, and 326K, a first cleaning unit 310, a secondary transfer backup roller 312, a first cleaning backup roller 313, and a tension roller 314.

The intermediate transfer belt 325 serves as a first endless belt and is spanned around and extended by the secondary transfer backup roller 312, the first cleaning backup roller 313, and the tension roller 314. The intermediate transfer belt 325 forms an endless loop and is rotated by at least one roller of the secondary transfer backup roller 312, the first cleaning backup roller 313, and the tension roller 314 in a counter-clockwise direction as indicated by an arrow in FIG. 10.

The four primary transfer rollers 326Y, 326M, 326C, and 326K are held in contact with the photoconductors 304Y, 304M, 304C, and 304K, respectively, via the intermediate transfer belt 325 that rotates continuously, so that respective primary transfer nip portions are formed. After receiving electrical power supplied by a power supply, not shown, the primary transfer rollers 326Y, 326M, 326C, and 326K apply respective primary transfer biases having a polarity opposed to toner particles (i.e., a positive polarity) to an inner surface of the intermediate transfer belt 325.

The intermediate transfer belt 325 has an electrical resistance condition suitable for desired electrostatic transfer of toner image with a primary transfer bias. While rotating continuously, the intermediate transfer belt 325 passes the primary transfer nip portions sequentially. At each primary transfer nip portion, a yellow toner image formed on the photoconductor 304Y, a magenta toner image formed on the photoconductor 304M, a cyan toner image formed on the photoconductor 304C, and a black toner image formed on the photoconductor 304K are transferred onto the surface of the intermediate transfer belt 325 by a nip pressure force and a primary transfer bias. As a result, an overlaid four-color toner image (hereinafter, "four-color toner image") is formed on the intermediate transfer belt 325. The secondary transfer backup roller 312 that is held extending the intermediate transfer belt 325 is disposed at a position to press against a sheet conveyance belt 329. According to this configuration, a secondary transfer nip portion at which the intermediate transfer belt 325 and the sheet conveyance belt 329 contact to each other along each of the intermediate transfer belt 325 and the sheet conveyance belt 329 is formed. The four-color toner image formed on the intermediate transfer belt 325 is transferred onto the recording medium P conveyed on the sheet conveyance belt 329 at the secondary transfer nip portion.

After passing the secondary transfer nip portion, residual toner remains on the intermediate transfer belt 325 without being transferred onto the recording medium P. Such residual toner may be removed by the first cleaning unit 310 that is disposed in contact with an outer surface of the intermediate transfer belt 325. Specifically, the intermediate transfer belt 325 is held between the first cleaning unit 310 and the first cleaning backup roller 313 that is disposed in contact with an inner surface of the intermediate transfer belt 325. The residual toner left on the outer surface of the intermediate transfer belt 325 is mechanically or electrostatically collected by the first cleaning unit 310.

Although the primary transfer rollers 326Y, 326M, 326C, and 326K described above employ a bias application method, the exemplary embodiments of the present invention are not intended to be limited to this configuration. For example, the primary transfer rollers 326Y, 326M, 326C, and 326K of the present invention may use a charger method to discharge from an electrode.

The second transfer unit 32B of the transfer unit 302 is disposed on the right-hand side of the first transfer unit 324 in FIG. 10, and includes a sheet conveyance belt 329 serving as a second endless belt, a second cleaning unit 318, a transfer charger 323, a secondary transfer roller 317, a nip extension roller 319, a tension roller 320, and a backup roller 321.

The sheet conveyance belt 329 is spanned around and extended by the secondary transfer roller 317, the nip extension roller 319, the tension roller 320, and the backup roller 321. The sheet conveyance belt 329 forms an endless loop and is rotated by at least one roller of the above-described rollers 317, 319, 320, and 321 in a clockwise direction in FIG. 10.

The secondary transfer backup roller 312 of the first transfer unit 324 is pressed against the extended part of the sheet conveyance belt 329 between the secondary transfer roller 317 and the nip extension roller 319 to form a secondary transfer nip portion.

The secondary transfer roller 317 is a cylindrical, metallic roller member or a roller member having a core metal covered by a conductive rubber layer, and is applied with a secondary transfer bias having a polarity opposed to toner particles (i.e., a positive polarity) by a power source, not shown.

As previously described, the pair of registration rollers 331 of the above-described sheet feed unit rotates the first registration roller 331*a* and the second registration roller 331*b* and stops rotating the rollers 331*a* and 331*b* when the recording medium P is held therebetween. Then, the pair of registration rollers 331 rotates the rollers 331*a* and 331*b* again at a given time so as to convey the recording medium P toward the secondary transfer nip portion. The four-color toner image on the intermediate transfer belt 325 is transferred onto the recording medium P at the secondary transfer nip portion and a full-color image is formed as a result.

In the first transfer unit 324, the secondary transfer backup roller 312 extends the intermediate transfer belt 325 to substantially reverse the direction of movement of the intermediate transfer belt 325. The most curved part of the intermediate transfer belt 325, where the direction of movement thereof is significantly reversed, is pressed against the sheet conveyance belt 329, which forms the secondary transfer nip portion. At a downstream end part of the secondary transfer nip portion, the intermediate transfer belt 325 is separated from the recording medium P so that the recording medium P is conveyed on the surface of the sheet conveyance belt 329. Then, the recording medium P is separated from the sheet conveyance belt 329 and conveyed to the fixing unit 335.

After conveying the recording medium P to the fixing unit 335, the sheet conveyance belt 329 is held between the backup roller 321 and the second cleaning unit 318 so that the residual toner remaining on the outer surface thereof can be cleaned mechanically or electrostatically.

The fixing unit 335 is disposed above the second transfer unit 328 in FIG. 10. The fixing unit 335 includes two fixing rollers 335*a* and 335*b* held in contact to each other while rotating in a forward direction, so that a fixing nip portion is formed. The fixing rollers 335*a* and 335*b* include heat members such as halogen lamp and fix the full-color image to the recording medium P that is sandwiched by the fixing rollers 335*a* and 335*b* in the fixing nip portion by applying heat from both sides.

The recording medium P having the fixed full-color image is reversed by sheet reverse guide members 336, discharged via a pair of discharging rollers 337 in a direction indicated by an arrow in FIG. 10, and accumulated on a sheet stacker 360 that is arranged on top of the frame of the image forming apparatus 300.

A toner bottle container 354 is disposed above the first transfer unit 324. The toner bottle container 354 contains toner bottles BY, BM, BC, and BK, each of which accommodates respective color toners to be supplied to the developing units 306Y, 306M, 306C, and 306K in the process units 303Y, 303M, 303C, and 303K, respectively.

Figure 12:
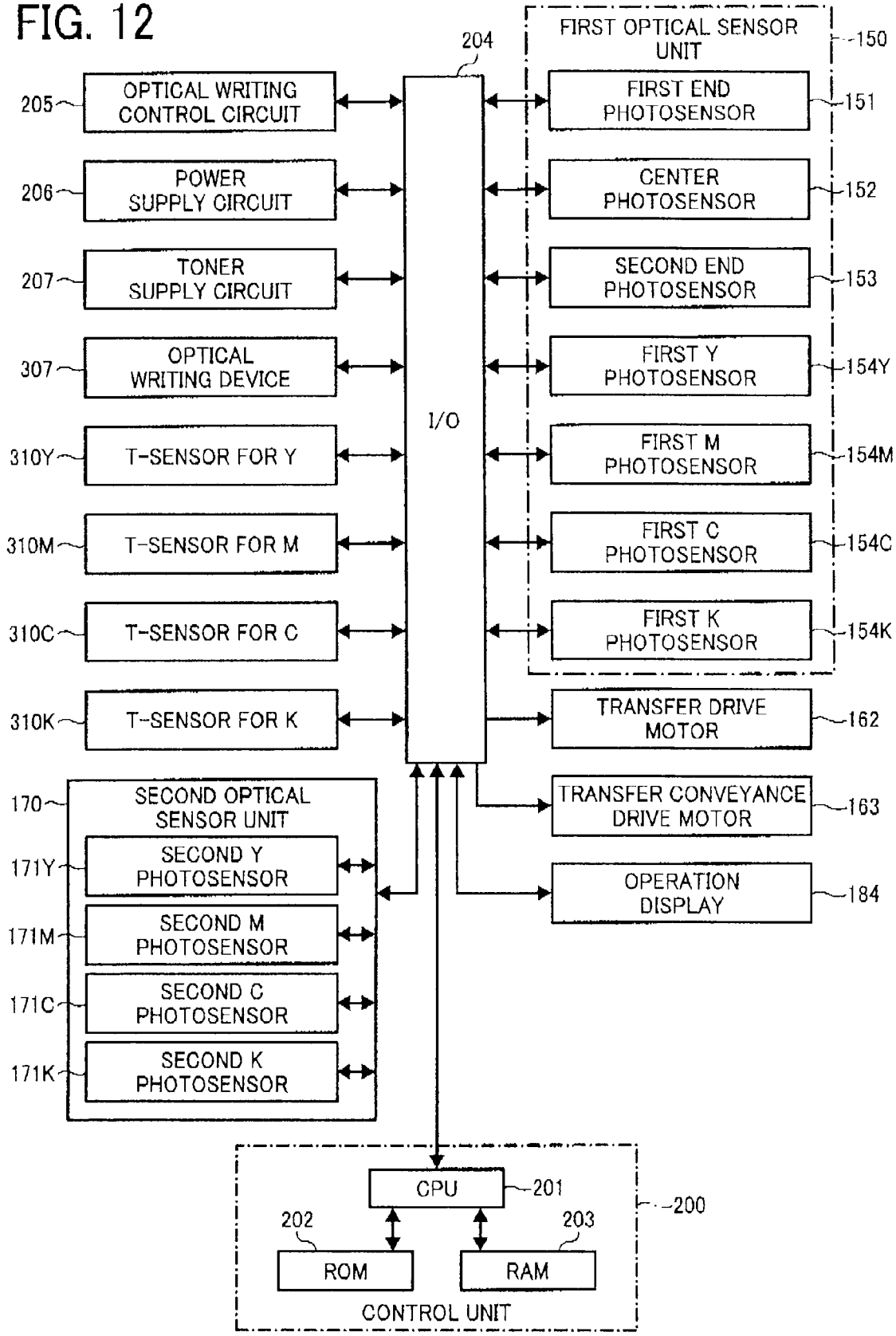
FIG. 12 is a block diagram showing a portion of electric circuits of the image forming apparatus of FIG. 10 according to Exemplary Embodiment 3 of the present invention.

Referring to FIG. 12, a block diagram showing a portion of electric circuits of the image forming apparatus 300 according to Exemplary Embodiment 3 of the present invention is described.

Elements or components of the electric circuits of the image forming apparatus 300 according to Exemplary Embodiment 3 may be denoted by the same reference numerals as those of the image forming apparatus 300 according to Exemplary Embodiments 1 and 2 and the descriptions thereof are omitted or summarized.

In FIG. 12, the image forming apparatus 300 includes a first optical sensor unit 150, a second optical sensor unit 170, a control unit 200, and an input and output (I/O) interface 204.

The control unit 200 serving as a calculating unit for the operations of the image forming apparatus 300 includes a central processing unit (CPU) 201, a read only memory (ROM) 202, and a random access memory (RAM) 203 temporarily storing the various data. Detailed descriptions of the components of the control unit 200 are omitted because the control unit 200 of FIG. 12 has the same functions as the components of the control unit 200 of FIG. 4.

The I/O interface 204 receives and sends various signals with respect to the peripheral control units.

The control unit 200 is connected via the I/O interface 204 to the optical writing device 307, T-sensors 310Y, 310M, 310C, and 310K, an optical writing operation control circuit 205 that is dedicated to the controls of the optical writing device 307, a power supply circuit 206, and a toner supply circuit 207.

The T-sensors 310Y, 310M, 310C, and 310K detect respective toner concentrations in the developing units 306Y, 306M, 306C, and 306K, respectively.

The control unit 200 is also connected via the I/O interface 204 to a transfer drive motor 162, a transfer conveyance drive motor 163 and an operation display part 184, which are same as the units shown in FIG. 4.

The control unit 200 is further connected via the I/O interface 204 to the first optical sensor unit 150 and the second optical sensor unit 170.

The first optical sensor unit 150 includes a first end photosensor 151, a central photosensor 152, a second end photosensor 153, a first photosensor for yellow toner or a first Y-toner photosensor 154Y, a first photosensor for magenta toner or a first M-toner photosensor 154M, a first photosensor for cyan toner or a first C-toner photosensor 154C, and a first photosensor for black toner or a first K-toner photosensor 154K.

The second optical sensor unit 170 includes a second photosensor for yellow toner or a second Y-toner photosensor 171Y, a second photosensor for magenta toner or a second M-toner photosensor 171M, a second photosensor for cyan toner or a second C-toner photosensor 171C, and a second photosensor for black toner or a second K-toner photosensor 171K.

The first end photosensor 151, the central photosensor 152, the second end photosensor 153, the first toner photosensors 154Y, 154M, 154C, and 154K and the second toner photosensors 171Y, 171M, 171C, and 171K are reflective type photosensors that reflect light emitted from respective light emitting units, not shown, and detect the reflected light with respective light emitting units, not shown.

The optical writing operation control circuit 205 controls the optical writing device 307 based on instructions issued by the control unit 200 via the I/O interface 204.

The power supply circuit 206 applies a high voltage to the charging unit 305 of the process unit 303 based on instructions issued by the control unit 200 via the I/O interface 204, and applies a developing bias to the developing unit 306.

The toner supply circuit 207 controls toner feeding units, not shown, based on instructions issued by the control unit 200 via the I/O interface 204, so as to control the amounts of toner replenished from the toner feeding units (or the toner bottles BY, BM, BC, and BK) to the two-component developer contained in the corresponding developing units 306.

The control unit 200 sends instructions based on the output values output from the T-sensors 310Y, 310M, 310C, and 310K via the I/O interface 204 to the toner supply circuit 207 that controls operations of the toner supply units. According to the instructions, the toner concentrations of the two-component developer accommodated in the respective developing units 306 may be kept in a reference toner concentration level.

Figure 13:
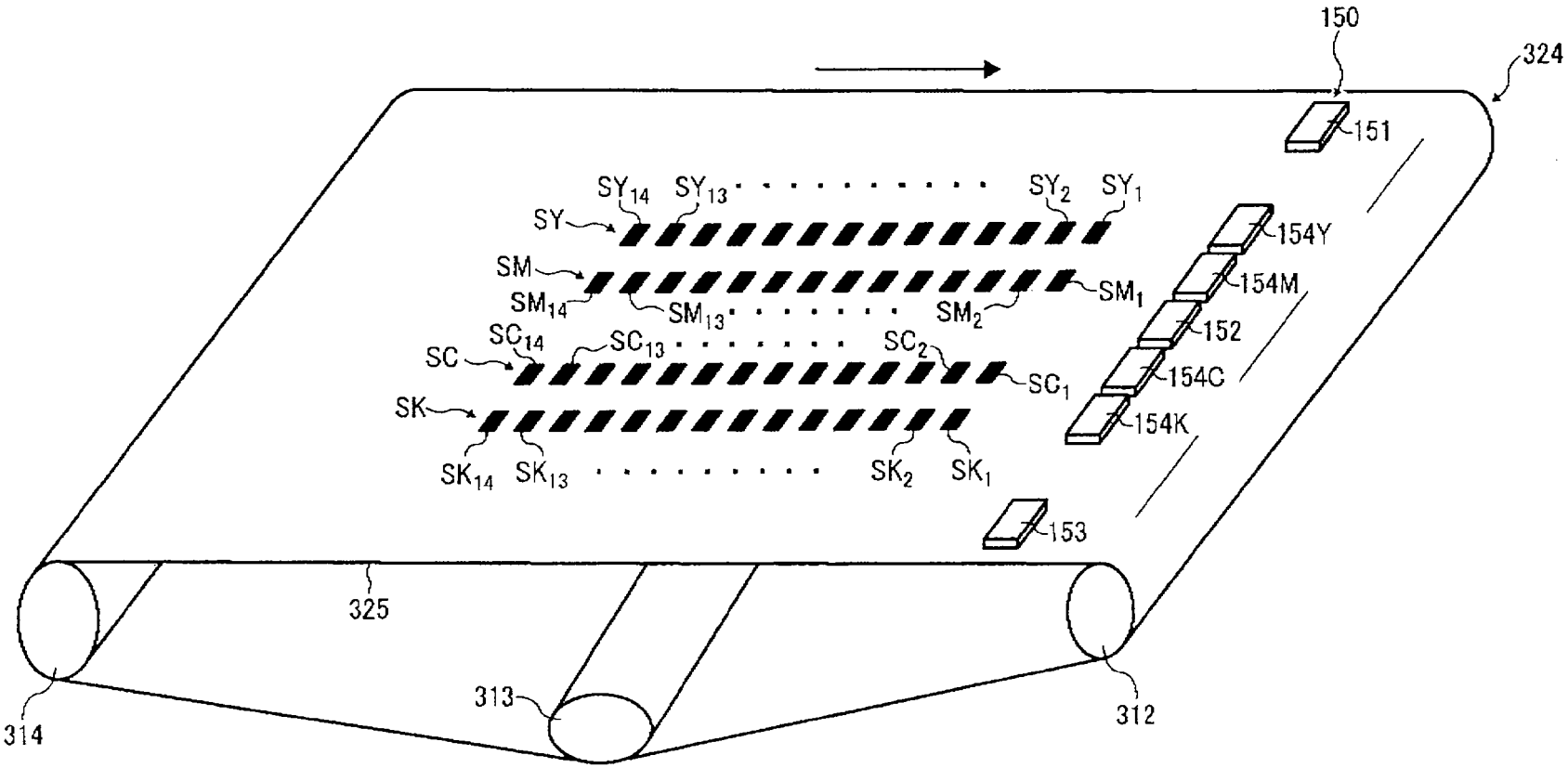
FIG. 13 is a schematic configuration of a transfer unit included in the image forming apparatus of FIG. 10.

Referring to FIG. 13, a schematic configuration of the first transfer unit 324 including the intermediate transfer belt 325 with reference toner images formed thereon is described.

The image forming apparatus 300 is controlled to perform the following image formation adjustment process at respective predetermined times or respective predetermined number of prints. More specifically, the image forming apparatus 300 can cause the optical writing operation control circuit 205 to control the optical writing device 307 based on instructions issued by the control unit 200 via the I/O interface 204.

The image forming apparatus 300 can also cause the control unit 200 to control the process units 303Y, 303M, 303C, and 303K, and the transfer unit 302. With the above-described controls, a group of reference toner images or a reference toner image group can be formed on the intermediate transfer belt 325 to detect image forming ability of the image forming apparatus 300. More specifically, the reference toner image group includes four reference toner image sets, which are a reference yellow toner image set SY, a reference magenta toner image set SM, a reference cyan toner image set SC, and a reference black toner image set SK. Each of the four reference toner image sets SY, SM, SC, and SK includes 14 reference toner images. The respective 14 reference toner images are formed by predetermined different pixel patterns having respective amounts of adhered toner different from each other.

As shown in FIG. 13, the reference yellow toner image set SY includes reference toner images SY1, SY2, . . . SY13, and SY14, the reference magenta toner image set SM includes reference toner images SM1, SM2, . . . SM13, and SM14, the reference cyan toner image set SC includes reference toner images SC1, SC2, . . . SC13, and SC14, and the reference black toner image set SK includes reference toner images SK1, SK2, . . . SK13, and SK14.

For example, the reference toner images SK1, SK2, . . . SK13, and SK14 of the reference black toner image set SK have respective amounts of adhered toner that are gradually increased. The reference toner images SK1, SK2, . . . SK13, and SK14 of the reference black toner image set SK are formed on the outer surface of the intermediate transfer belt 325 at predetermined intervals in a direction of movement of the loop-shaped intermediate transfer belt 325. The toner concentration of image or the respective amounts of adhered toner per unit area with respect to the reference toner images SK1, SK2 . . . SK13, and SK14 of the reference black toner image set SK are detected by the first K-toner photosensor 154K of the first optical sensor unit 150. The detection results are sent as an output value Vpi ("i" can be any of 1 to 14 corresponding to the reference toner images SK1, SK2, . . . SK13, and SK14) via the I/O interface 204 to the RAM 203 in which the detection results are stored.

For the first optical sensor unit 150, the photosensors of different toner colors are placed in a line across the width of the intermediate transfer belt 325. For example, the above-described reference black toner image set SK is located at the same distance as the position of the first K-toner photosensor 154K across the width of the outer surface of the intermediate transfer belt 325, and is detected by the first K-toner photosensor 154K as a result. Same as the reference black toner image set SK, the reference yellow toner image set SY, the reference magenta toner image set SM, and the reference cyan toner image set SC, each having 14 reference toner images, are located at the same distances as the respective positions of the first Y-toner photosensor 154Y, the first M-toner photosensor 154M, and the first C-toner photosensor 154C. Therefore, the reference black toner image set SK, the reference yellow toner image set SY, the reference magenta toner image set SM, and the reference cyan toner image set SC are detected by the first Y-toner photosensor 154Y, the first M-toner photosensor 154M, and the first C-toner photosensor 154C, respectively. Then, the output values Vp1 through Vp14 of the first Y-toner photosensor 154Y, the first M-toner photosensor 154M, and the first C-toner photosensor 154C, which are the detection results of the amounts of adhered toner per unit area with respect to the reference yellow, magenta, and cyan toner image sets SY, SM, and SC, are also sent via the I/O interface 204 to the RAM 203.

Based on the output values stored in the RAM 203 and a data table stored in the RON 202, the control unit 200 calculates the output values to the corresponding amount of adhered toner per unit area and stores the calculation results as data of the amounts of adhered toner to the RAM 203.

The control unit 200 refers to the development potential data and the toner amount data stored in the RAM 203, then selects, by each color of toner, an area in which the development characteristic or the relationship of the development potential data and the toner amount data (see the graph of FIG. 6) forms a linear line, and performs a smoothing operation of the above-described data. After the smoothing operation has been performed, the control unit 200 applies a least squares method with respect to the smoothed data of the development potential data and the toner amount data to perform a collinear approximation of the development characteristic of each developing unit 306. Further, the control unit 200 obtains, for each color of toner, an equation of a straight line of the development characteristic of the developing unit 306. The equation is "y=ax+b". The control unit 200 then adjusts the image forming ability of each of the process units 303Y, 303M, 303C, and 303K based on an inclination "a" in the equation.

As shown in FIG. 13, in the image forming condition adjusting operation, the reference yellow toner image set SY including the 14 reference toner images SY1, SY2, . . . SY13, and SY14 is formed in predetermined pitches in a moving direction or in a sub-scanning direction of the intermediate transfer belt 325. The reference magenta toner image set SM including the reference toner images SM1, SM2, . . . SM13, and SM14 is formed in predetermined pitches in the sub-scanning direction of the intermediate transfer belt 325 and in a main scanning direction of or in parallel with the reference yellow toner image set SY. The reference cyan toner image set SC including the reference toner images SC1, SC2, . . . SC13, and SC14 is formed in predetermined pitches in the sub-scanning direction of the intermediate transfer belt 325 and in a main scanning direction of or in parallel with the reference magenta toner image set SM. The reference black toner image set SK including the reference toner images SK1, SK2, . . . SK13, and SK14 is formed in predetermined pitches in the sub-scanning direction of the intermediate transfer belt 325 and in a main scanning direction of or in parallel with the reference cyan toner image set SC.

Figure 14:
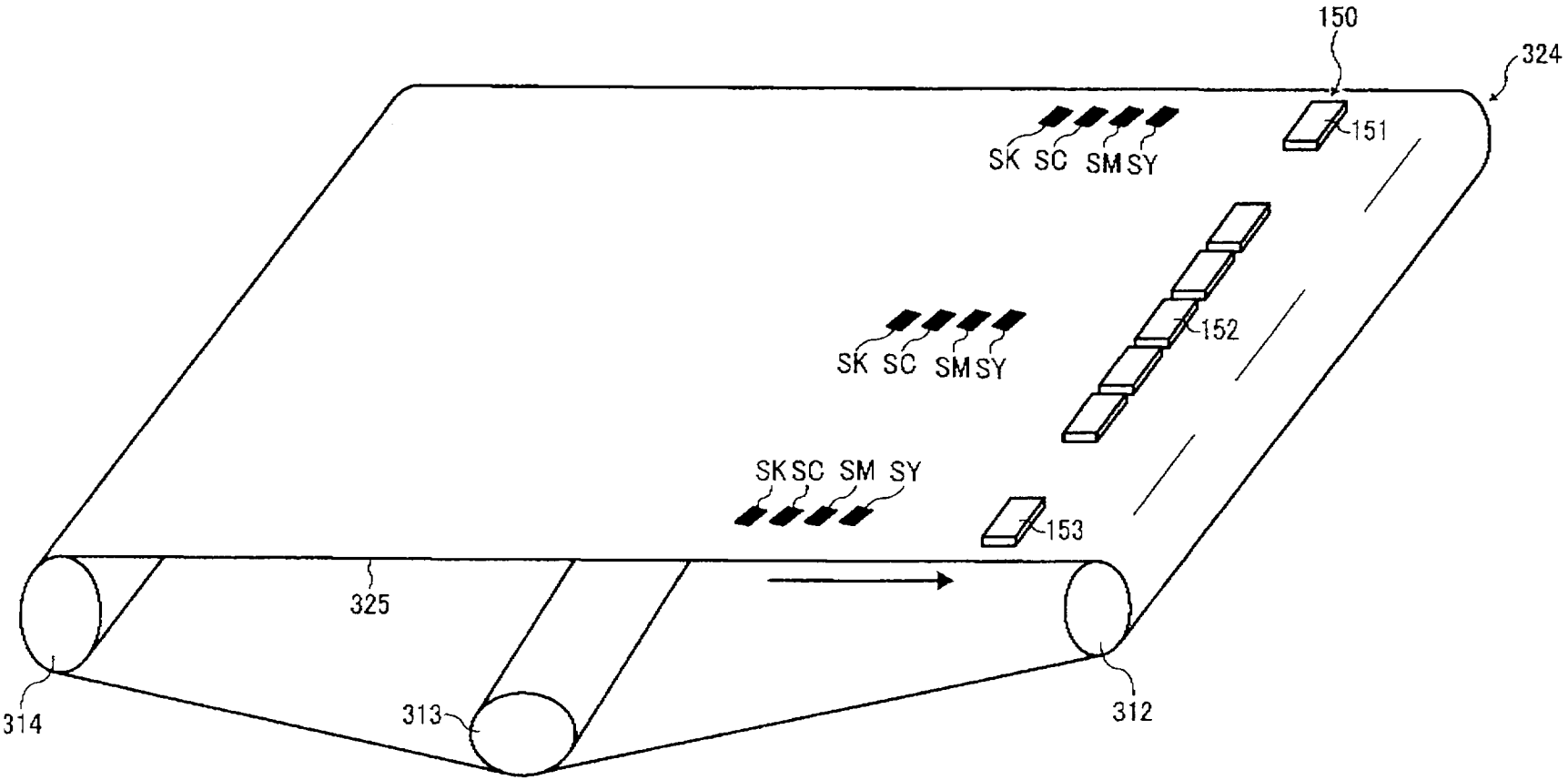
FIG. 14 is a schematic structure of an intermediate transfer belt included in the image forming apparatus of FIG. 10.

Referring to FIG. 14, a schematic structure of the intermediate transfer belt 325 having a different arrangement of patch patterns formed thereon is described.

The image forming apparatus 300 also has a function to perform a registration skew adjustment at a predetermined time. More specifically, after adjusting the developing bias, etc. with the above-described operation, the control unit 200 forms three sets of patch patterns for detecting registration skew at both ends and at the center of the intermediate transfer belt 325 along a widthwise direction of the intermediate transfer belt 325, as shown in FIG. 14. Each of the respective sets of patch patterns includes four reference yellow, magenta, cyan, and black toner image sets SY, SM, SC, and SK disposed in predetermined pitches in the sub-scanning direction of the intermediate transfer belt 325. The reference yellow, magenta, cyan, and black toner image sets SY, SM, SC, and SK are arranged to locate the respective reference toner images of the same color in a linear line in the main scanning direction.

In FIG. 14, the first end photosensor 151 detects the reference yellow, magenta, cyan, and black toner image sets SY, SM, SC, and SK of the patch pattern that is formed in the vicinity of the far side in the widthwise direction of the intermediate transfer belt 325. The central photosensor 152 detects the reference yellow, magenta, cyan, and black toner image sets SY, SM, SC, and SK of the patch pattern that is formed in the vicinity of the center portion in the widthwise direction of the intermediate transfer belt 325. The second end photosensor 153 detects the reference yellow, magenta, cyan, and black toner image sets SY, SM, SC, and SK of the patch pattern that is formed in the vicinity of the near side in the widthwise direction of the intermediate transfer belt 325.

When images of the reference yellow, magenta, cyan, and black toner image sets SY, SM, SC, and SK are formed at appropriate times to each other, the intervals of forming and detecting the images of the respective reference yellow, magenta, cyan, and black toner image sets SY, SM, SC, and SK may be equal. On the contrary, when the images of the reference yellow, magenta, cyan, and black toner image sets SY, SM, SC, and SK are not appropriate, the intervals of forming and detecting the images of the reference yellow, magenta, cyan, and black toner image sets SY, SM, SC, and SK cannot be equal.

Further, when the images of the reference yellow, magenta, cyan, and black toner image sets SY, SM, SC, and SK are optically written in an accurate manner, the images having the same color in the three sets of patch patterns should be detected simultaneously. However, when the images are askew, the detection times may be different from each other.

Thus, the control unit 200 adjusts the start time to optically write images to the photoconductors 304 by the optical writing device 307 according to deflection of the intervals and times of the images of the reference yellow, magenta, cyan, and black toner image sets SY, SM, SC, and SK in the main scanning and sub-scanning directions and adjusts the respective angles of optical mirrors so that image shifts and skews on the toner images of each color can be prevented.

In the image forming apparatus 300, the control unit serves as an image formation adjustment unit to perform an image formation adjustment process as described above, and the process units 303Y, 303M, 303C, and 303K, the optical writing device 307, and the transfer unit 302 form an image forming mechanism 301. The toner image forming mechanism 301 forms a toner image on the recording medium P.

Further, the photosensors 151, 152, 153, 154Y, 154M, 154C, and 154K of the first optical sensor unit 150 serve as a first detector that detects the toner image transferred onto a predetermined position on the surface of the intermediate transfer belt 325 and the concentration of the toner image.

Further, the control unit 200 serves as an image formation adjustment unit that adjusts the charge potential uniformly charged on the surface of the photoconductor 304 and the developing bias that are image forming conditions related to the image forming density, based on the detection results obtained by the photosensors 151, 152, 153, 154Y, 154M, 154C, and 154K that serve as the first detector.

Further, the control unit 200 performs an image formation adjustment process for adjusting the start time of optical writing and the inclination of the optical mirrors which are conditions related to positioning of a toner image of each color on the surface of the intermediate transfer belt 325, based on the detection results obtained by the photosensors 151, 152, 153, 154Y, 154M, 154C, and 154K.

The first optical sensor unit 150 that serves as a first detector for an image formed on the intermediate transfer belt 325 is disposed at a given position. That is, the first optical sensor unit 150 is disposed to detect a toner image on the surface of the intermediate transfer belt 325 and positioned between the primary transfer nip portion at which the toner image is transferred from the photoconductor 304 onto the intermediate transfer belt 325 and the secondary transfer nip portion at which the toner image is transferred from the intermediate transfer belt 325 onto the recording medium conveyed on the sheet conveyance belt 329.

Next, a description is given of a characteristic structure of the image forming apparatus 300 according to Exemplary Embodiment 3 of the present invention.

The control unit 200 serves as a belt speed adjustment unit to perform a belt speed adjustment process for adjusting a speed of movement of the intermediate transfer belt 325 prior to the above-described image formation adjustment process.

In the belt speed adjustment process, the control unit 200 causes to form a scale pattern including multiple K-toner images arranged at predetermined pitches in a direction of movement of the intermediate transfer belt 325 along the entire circumference thereof. The first K-toner image photosensor 154K shown in FIG. 13 detects each K-toner image in the scale pattern. Based on the time intervals of detection of the K-toner images in the scale pattern, an average speed of movement of the intermediate transfer belt 325 per circumference thereof can be obtained. When the obtained average speed of movement of the intermediate transfer belt 325 is deviated from a predetermined regular speed, the setting of drive speed of the transfer drive motor 162 shown in FIG. 13 is changed so that the intermediate transfer belt 325 can be operated at the regular speed in the image forming operation after this adjustment. By so doing, even if environmental changes cause the diameter of a drive roller that drives the intermediate transfer belt 325 and/or the thickness of the intermediate transfer belt 325 to change and the average speed of the intermediate transfer belt 325 is deviated from the regular speed, the speed of movement of the intermediate transfer belt 325 can be adjusted to the regular speed.

After the belt speed adjustment process, the control unit 200 causes to form the K-toner image having a given reference size while no recording medium is fed, and applies the secondary transfer bias to the secondary transfer roller 317 shown in FIG. 10. Then, the scale pattern formed on the intermediate transfer belt 325 is transferred onto the recording medium P conveyed on the sheet conveyance belt 329 as secondary transfer.

The second optical sensor unit 170 is disposed on the left-hand side of the sheet conveyance belt 329 after the secondary transfer nip portion. As previously shown in FIG. 12, the second optical sensor unit 170 includes the second Y-toner photosensor 171Y, the second M-toner photosensor 171M, the second C-toner photosensor 171C, and the second K-toner photosensor 171K. The above-described K-toner image having a reference size that is secondarily transferred onto the recording medium P conveyed on the sheet conveyance belt 329 is detected by the second K-toner photosensor 171K.

The detection time period taken for detecting the K-toner image of reference size indicates how far the K-toner image is moved in a distance of movement of the sheet conveyance belt 329. When both the intermediate transfer belt 325 and the sheet conveyance belt 329 move at the respective regular speeds, the size of the K-toner image of reference size obtained based on the detection time period can be equal to a reference value. However, when the sheet conveyance belt 329 does not move at the regular speed due to environmental changes and therefore the speed of the sheet conveyance belt 329 is different from the speed of the intermediate transfer belt 325, the size of the K-toner image of reference size obtained based on the detection time period can be larger (longer) or smaller (shorter) than the reference value. Since the value different from the reference value depends on the average speed of the sheet conveyance belt 329, the average value of the sheet conveyance belt 329 can be obtained based on the detection time period. Therefore, the control unit 200 obtains the average speed of movement of the sheet conveyance belt 329 based on the above-described detection time period and, when the result is deviated from the regular speed, the drive speed of the transfer conveyance drive motor 163 in FIG. 12 may be adjusted to the regular speed. By adjusting the speed of movement of the intermediate transfer belt 325 and the speed of movement of the sheet conveyance belt 329 as described above, image distortion caused by the difference between the speed of movement of the intermediate transfer belt 325 and the speed of movement of the sheet conveyance belt 329 can be prevented in the image forming operation after this adjustment.

After the belt speed adjustment process, the control unit 200 performs the previously described image formation adjustment process. In the belt speed adjustment process, a process for adjusting the average speed of movement of the sheet conveyance belt 329 corresponds to the transfer adjustment process for adjusting the condition for secondary transfer performed by the transfer device 340. Therefore, the control unit 200 also serves as a transfer adjustment unit that adjusts transfer conditions such as the average speed of movement of the sheet conveyance belt 329, based on the detection results obtained by the second photosensors 171Y, 171M, 171C, and 171K of the second optical sensor unit 170 that serves as a transferred image detector.

Further, the control unit 200 performs a secondary transfer bias adjustment process that corresponds to the transfer adjustment process while conducting the above-described image formation adjustment process. More specifically, the control unit 200 causes the process unit 303K to form patch patterns for bias adjustment on the photoconductor 304K. The patch patterns for bias adjustment includes three K-toner patch patterns arranged at given pitches in a direction of movement of the photoconductor 304K, and respective K-toner patch patterns are developed with an identical image concentration to each other.

After the control unit 200 transfers the patch patterns for bias adjustment formed on the photoconductor 304K onto the intermediate transfer belt 325, the first K-toner photosensor 154K of the first optical sensor unit 150 detects respective amounts of adhered toner per unit area of three K-toner patch patterns of the patch patterns for bias adjustment to calculate the average value. Then, the patch patterns for bias adjustment formed on the intermediate transfer belt 325 are transferred onto the recording medium P. At this time, the transfer current values for the secondary transfer bias are changed to three steps. Among the three K-toner patch patterns of the patch patterns for bias adjustment, the leading K-toner patch pattern is transferred onto the recording medium P under a condition that the transfer current value thereof is adjusted by adding a coefficient I to a given reference transfer current value Io. The center K-toner patch pattern is transferred onto the recording medium P under a condition that the transfer current value thereof is adjusted to the same value as the reference transfer current value Io. The trailing K-toner patch pattern is transferred onto the recording medium P under a condition that the transfer current value thereof is adjusted by subtracting the coefficient I from the given reference toner current value Io.

The amounts of adhered toner to these K-toner patch patterns are detected by the second K-toner photosensor 171K of the second optical sensor unit 170. Of the detection results of the amount of adhered toner to the K-toner patch patterns on the recording medium P, a detection result V1 corresponds to the amount of adhered toner to the leading K-toner patch pattern, a detection result V2 corresponds to the amount of adhered toner to the center K-toner patch pattern, and a detection result V3 corresponds to the amount of adhered toner to the trailing K-toner patch pattern. Among the detection results V1, V2, and V3, one transfer current value that is closest to a target value V0 is specified as a specific value Vx.

The control unit 200 then determines whether a difference between the specific value Vx and a target value V0 remains within its acceptable range. When the difference is within the acceptable range, a target control value of the secondary transfer current in the subsequent image forming operation is set to the same value as the specific value Vx. By contrast, when the difference is out of the acceptable range, a given coefficient is added to, subtracted from, or multiplied by the specific value Vx to update as a reference transfer current value Io.

Then, the control unit 200 performs the secondary transfer again to form the patch patterns for bias adjustment, transfer the patch patterns at different transfer current values, and detect the amounts of adhered toner to the patch patterns again. Specifically, the control unit 200 also serves as the transfer adjustment unit that adjusts the secondary transfer bias as a transfer condition. The secondary transfer bias adjustment process can prevent secondary transfer failure caused by inappropriateness of the secondary transfer bias due to environmental changes.

The second Y-toner photosensor 171Y, the second M-toner photosensor 171M, and the second C-toner photosensor 171C of the second optical sensor unit 170 are multi-reflective photosensors that can receive both specular and diffuse reflection light. The reason why the multi-reflective photosensor is employed is described below. That is, if a specular reflection photosensor is used when an amount of adhered toner per unit area with respect to the reference toner images of Y-toner, M-toner, and C-toner is detected, the detection accuracy of the amount of adhered toner becomes lower as the amount of adhered toner relatively increases. By contrast, if a diffuse reflection photosensor is used, the detection accuracy of the amount of adhered toner becomes higher as the amount of adhered toner relatively decreases. As long as the transfer rates of toner images during the primary transfer and the secondary transfer are not reduced significantly, the amount of adhered toner per unit area with respect to the reference toner images transferred onto the recording medium P conveyed on the sheet conveyance belt 329 can be relatively large, and therefore the diffuse reflection photosensor is suitable.

However, when the transfer rate of the toner images during the primary transfer and the secondary transfer is significantly reduced due to great environmental changes, the amount of adhered toner with respect to the reference toner images transferred onto the recording medium P conveyed on the sheet conveyance belt 329 may be relatively small. In such a case, by detecting the amount of adhered toner with accuracy, the secondary transfer bias can be adjusted more appropriately.

By contrast, the first Y-toner photosensor 154Y, the first M-toner photosensor 154M, and the first C-toner photosensor 154C of the first optical sensor unit 150 are diffuse reflection photosensors. The transfer rate in the primary transfer is not affected by a decrease in transfer rate of the toner images in the secondary transfer, and the amount of adhered toner per unit area of the reference toner images formed on the intermediate transfer belt 325 may not be relatively small. Therefore, the diffuse reflection photosensor can be used to reduce the amount of adhered toner per unit area with respect to the reference toner images. Accordingly, the detection accuracy of the amount of adhered toner in the first optical sensor unit 150 may not degrade and can achieve low cost, compared when the first optical sensor unit 150 uses the multi-reflective photosensor.

The control unit 200 can be configured to change a value of Vm according to a mode setting condition such as "document mode" and "photo mode" when a condition of standard of an output voltage from a photosensor is set to Vo±Vm [V].

In FIG. 10, the second optical sensor unit 170 is disposed at a given position. Specifically, the given position is where a toner image formed on the recording medium P conveyed on the sheet conveyance belt 329 serving as a second endless belt is detected when the recording medium P is conveyed on the surface of the sheet conveyance belt 329 while a toner image formed on the surface of the sheet conveyance belt 329 is detected when the recording medium P is not carried thereby. That is, whenever a toner image formed on the surface of the intermediate transfer belt 325 is transferred onto the sheet conveyance belt 329 in the secondary transfer nip portion, the second optical sensor unit 170 can detect the toner image.

In the image forming apparatus 300, an output image provided for user is formed on the recording medium P. Therefore, the second optical sensor unit 170 detects the position and toner concentration of the toner image on the recording medium P so that a difference of belt speeds, a secondary transfer failure, and/or other factors that degrade the output toner image can be detected with accuracy. However, it needs to form patch patterns or other patterns on the recording medium P to detect the factors, and therefore needs a recording medium P for outputting the patterns thereon. It is, however, not desirable to consume the recording medium P for such purpose.

To avoid such unnecessary consumption of the recording medium P, the control unit 200 of the image forming apparatus 300 performs the following process when the above-described reference patterns, patch patterns, or scale patterns are transferred onto the recording medium P and are detected by the second optical sensor unit 170. That is, reference patterns, patch patterns, or scale patterns that are same as the patterns transferred onto the recording medium P are formed on the intermediate transfer belt 325 again and transferred onto the surface of the sheet conveyance belt 329. Then, the control unit 200 calculates rates of misalignment and difference in toner concentration between the patterns on the recording medium P and the patterns on the sheet conveyance belt 329. Thereafter, until a predetermined time arrives, the patterns are transferred onto the sheet conveyance belt 329 instead of the recording medium P, and the control unit 200 serves as a correction unit to calibrate or correct the detection results obtained by the second optical sensor unit 170 according to the above-described rates of misalignment and difference in toner concentration.

For example, when adjusting a transfer current value in the secondary transfer, each parameter can be defined as follows:

Vba: a sensor output value for K-toner patch patterns transferred onto the recording medium P at current value Ia;

Vpa: a sensor output value for K-toner patch patterns transferred onto the sheet conveyance belt 329 at current value Ia;

Vbb: a sensor output value for K-toner patch patterns transferred onto the recording medium P at current value Ib;

Vpb: a sensor output value for K-toner patch patterns transferred onto the sheet conveyance belt 329 at current value Ib; and Vpo: a target sensor output value for K-toner patch patterns transferred onto the sheet conveyance belt 329.

With the above-described parameters, a target sensor output value for K-toner patch patterns on the recording medium P can be obtained by calculating with an equation, "Vbo=(Vbb−Vba)*(Vpo−Vpa)/(Vpb−Vpa)". This equation is to correct the sensor output value for patch patterns on the sheet conveyance belt 329. However, with the above-described equation, the sensor output value for patch patterns transferred onto the sheet conveyance belt 329 can also be corrected to the sensor output value for patch patterns transferred onto the recording medium P.

In FIG. 10, a side cover 350 is provided to the frame of the image forming apparatus 300. The side cover 350 is rotatable about a rotary shaft 350*a* to open and close with respect to the frame of the image forming apparatus 300. The second transfer unit 32B including the sheet conveyance belt 329 and the second cleaning unit 318 rotate with the side cover 350 while being supportably provided in the side cover 350. When the side cover 350 is opened, the sheet conveyance belt 329 is largely separated from the first transfer unit 324 to expose the sheet feed path 333 to the outside of the image forming apparatus 300. With this action, a jammed paper in the sheet feed path 333 can be removed easily.

The second optical sensor unit 170 serving as a transferred image detector is disposed in the vicinity of the second transfer unit 328 to detect the outer surface of the sheet conveyance belt 329 or the patch patterns formed on the recording medium P conveyed on the sheet conveyance belt 329. However, different from the second transfer unit 328, the second optical sensor unit 170 is fixedly provided in the frame of the image forming apparatus 300. As the side cover 350 opens and closes, a relative position of the sheet conveyance belt 329 that moves with the side cover 350 and the second optical sensor unit 170 that is fixedly provided in the frame of the image forming apparatus 300 may vary. When the relative position thereof varies, each patch pattern cannot be detected with accuracy.

Therefore, the image forming apparatus 300 includes a positioning mechanism 180 that positions the second optical sensor unit 170 therein, based on the sheet conveyance belt 329 as a reference. With this configuration, the change of relative position of the sheet conveyance belt 329 and the second optical sensor unit 170 associated with the movement of the side cover 350 is prevented, resulting in accurate detection of the patch patterns.

Figure 15:
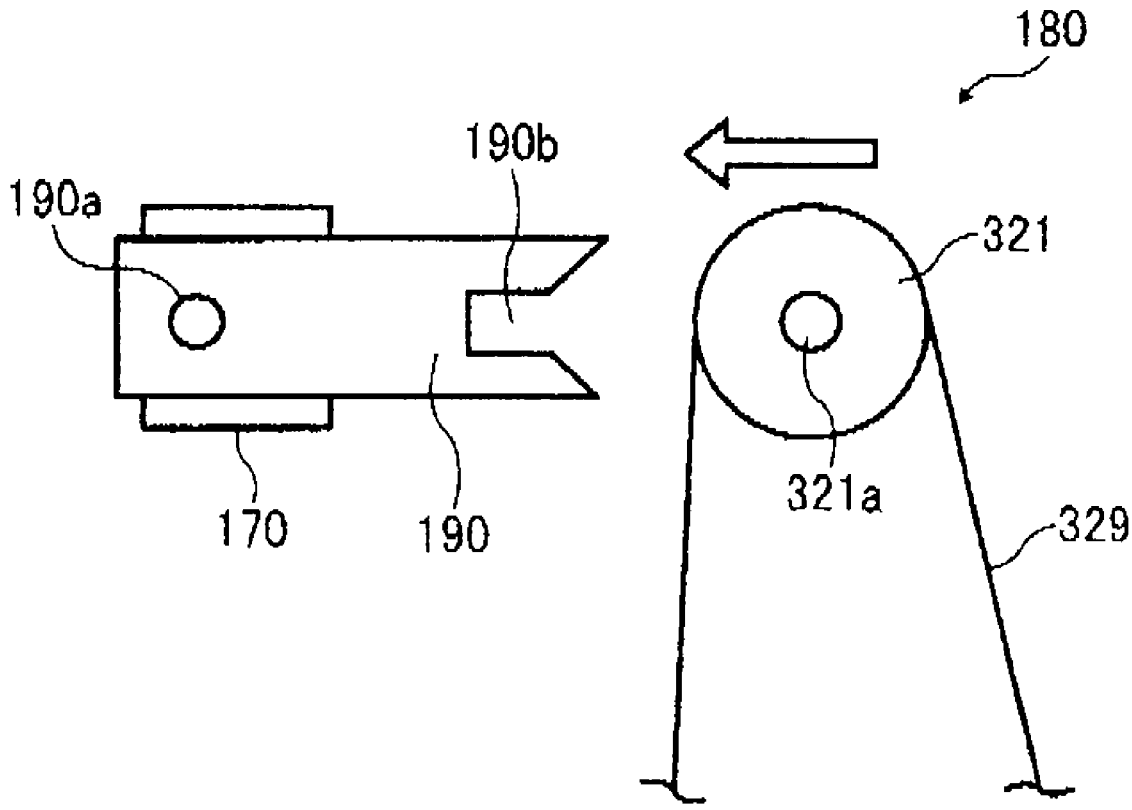
FIG. 15 is an enlarged view of a positioning mechanism included in the image forming apparatus of FIG. 10.

Referring to FIG. 15, a description is given of the positioning mechanism 180 of the second optical sensor unit 170. FIG. 15 is an enlarged view of a schematic configuration of the positioning mechanism 180.

In FIG. 15, the second optical sensor unit 170 is fixedly mounted on a holder 190 that is supportably disposed to the frame of the image forming apparatus 300 to rotate about a rotary shaft 190*a*. When the side cover 350 shown in FIG. 10 is closed, the sheet conveyance belt 329 of the second transfer unit 328 is moved in a direction indicated by an arrow shown in FIG. 15 and is engaged to a regular position in the image forming apparatus 300 simultaneously. Then, a rotary shaft 321*a* of the backup roller 321 that extends the sheet conveyance belt 329 is engaged to a concave portion 190*b* of the holder 190. With this action, the second optical sensor unit 170 is positioned according to the position of the sheet conveyance belt 329.

Although the optical sensors described above are generally reflective photosensors that detect the amount of reflected light, exemplary embodiments of the present invention are not intended to be limited to this configuration. For example, a transmissive photosensor that detects the amount of transmitted light with respect to the intermediate transfer belt 325 can be used. Even with the transmissive photosensor, the toner image can be detected and the amount of adhered toner can be obtained by detecting light transmission rate that is an optical characteristic of the intermediate transfer belt 325 instead of detecting light reflection rate on the surface of, the intermediate transfer belt 325. In this case, the intermediate transfer belt 325 includes light transmissive material for a detection target part.

Further, an encoder that can also serve as a first detector can be provided to a driven roller that rotates with the intermediate transfer belt 325. According to the detection results obtained by the encoder, the control unit 200 can adjust the speed of movement of the intermediate transfer belt 325.

Further, the intermediate transfer belt 325 can include a scale at end portion in a widthwise direction on the surface thereof and can further include a scale detector that serves as the belt speed detector and detects the marks in the scale. With this configuration, the control unit 200 can adjust the speed of movement of the intermediate transfer belt 325 according to the detection results obtained by the scale detector.

The above-described exemplary embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed is:

1. An image forming apparatus, comprising:

an image forming mechanism to form a toner image on a surface of an image carrier;

a transfer mechanism disposed in the vicinity of the image forming mechanism to transfer the toner image formed on the surface of the image carrier onto a first endless belt and further onto a second endless belt, the first endless belt partly held in contact with the image carrier to receive the toner image formed on the image carrier, the second endless belt partly held in contact with the first endless belt to receive the toner image from the first endless belt, the second endless belt receiving the toner image from the first endless belt either directly on a surface thereof or via a recording medium conveyed on the surface thereof;

a first detector that detects one of a speed of movement of the first endless belt and a toner image transferred at a predetermined position on the surface of the first endless belt;

a belt speed adjustment unit to adjust a speed of movement of the first endless belt based on detection results obtained by the first detector;

a second detector that detects the toner image transferred at a predetermined position on the surface of the second endless belt; and a transfer adjustment unit to adjust a speed of movement of the second endless belt based on detection results obtained by the second detector.

2. The image forming apparatus according to claim 1, further comprising:

an image formation adjustment unit to adjust operation of the image forming mechanism based on detection results obtained by the first detector.

3. The image forming apparatus according to claim 2, wherein the image forming mechanism includes multiple image carriers corresponding to toner images of different colors, the transfer mechanism transferring the toner images of different colors formed on the multiple image carriers onto the first endless belt, the image formation adjustment unit adjusting positions of the toner images formed on the first endless belt based on detection results obtained by the first detector detecting the toner images of different colors formed on the first endless belt.

4. An image forming apparatus, comprising:

an image forming mechanism to form a toner image on a surface of an image carrier;

a transfer mechanism disposed in the vicinity of the image forming mechanism to transfer the toner image formed on the surface of the image carrier onto a first endless belt and further onto a second endless belt, the first endless belt partly held in contact with the image carrier to receive the toner image formed on the image carrier, the second endless belt partly held in contact with the first endless belt to receive the toner image from the first endless belt, the second endless belt receiving the toner image from the first end belt either directly on a surface thereof or via a recording medium conveyed on the second endless belt;

a residual image detector to detect a residual image remaining on the surface of the first endless belt at a predetermined position thereon after the toner image is transferred either directly onto the surface of the second endless belt or via the recording medium conveyed on the second endless belt; and a belt image detector disposed facing the second endless belt across a gap to detect the toner image transferred at a predetermined position on the surface of the second endless belt and a toner concentration of the toner image.

5. The image forming apparatus according to claim 4, further comprising a transfer adjustment unit to adjust a transfer rate of the toner image transferred from the first endless belt onto the second endless belt based on detection results obtained by the residual image detector and detection results obtained by the belt image detector.

6. The image forming apparatus according to claim 5, further comprising an image formation adjustment unit to adjust an image formation concentration based on the detection results obtained by the residual image detector and detection results obtained by the belt image detector.

7. The image forming apparatus according to claim 6, wherein the image forming mechanism includes multiple image carriers corresponding to toner images of different colors, the transfer mechanism transferring toner images of different colors formed on multiple image carriers onto the first endless belt, the belt image detector detecting the toner images of different colors transferred from the first endless belt onto the second endless belt, the image formation adjustment unit adjusting positions of each of the toner images of different colors on the first endless belt, based on detection results of the belt image detector.

8. The image forming apparatus according to claim 5, wherein the residual image detector includes a specular reflection photosensor to receive specular reflection light.

9. An image forming apparatus, comprising:

an image forming mechanism to form a toner image on a surface of an image carrier;

a transfer mechanism disposed in the vicinity of the image forming mechanism to transfer the toner image formed on the surface of the image carrier onto a first endless belt and further onto a second endless belt, the first endless belt partly held in contact with the image carrier to receive the toner image formed on the image carrier, the second endless belt partly held in contact with the first endless belt to receive the toner image from the first endless belt-onto a recording medium conveyed on the second endless belt, the toner image transferred from the first endless belt onto a predetermined position on a surface of the recording medium; and a transferred image detector to detect the toner image transferred from the first endless belt onto the recording medium.

10. The image forming apparatus according to claim 9, further comprising a transfer adjustment unit to adjust a speed of movement of the second endless belt based on detection results obtained by the transferred image detector.

11. The image forming apparatus according to claim 10, further comprising:

a detector to detect one of a speed of movement of the first endless belt and the toner image transferred at a predetermined position onto the surface of the first endless belt; and a belt speed adjustment unit to adjust a speed of movement of the first endless belt based on detection results obtained by the detector.

12. The image forming apparatus according to claim 9, wherein the transferred image detector further detects a toner concentration of the toner image formed on the recording medium, the image forming apparatus further comprising a transfer adjustment unit to adjust a transfer current for forming a transfer electric field to contribute to a transfer of the toner image from the first endless belt onto the recording medium based on detection results obtained by the transferred image detector.

13. The image forming apparatus according to claim 12, further comprising:

a first detector disposed facing the first endless belt across a gap to detect the toner image transferred at a predetermined position onto the surface of the first endless belt and a toner concentration of the toner image; and an image formation adjustment unit to adjust operation of the image forming mechanism based on detection results obtained by the first detector.

14. The image forming apparatus according to claim 12, wherein, based on detection results of toner concentrations of the toner images obtained by the transferred image detector, the transfer adjustment unit transfers the toner image formed on the first endless belt onto the recording medium with multiple transfer currents and adjusts the transfer currents when an image is formed according to image forming instructions issued by operator.

15. The image forming apparatus according to claim 14, wherein the transfer adjustment unit determines the transfer current based on a transfer current value determined as the transfer adjustment unit adjusts the transfer currents.

16. The image forming apparatus according to claim 9, wherein the image carrier includes multiple image carriers corresponding to toner images of different colors, the transfer mechanism transferring the toner images of different colors formed on the multiple image carriers onto the first endless belt, the image forming apparatus further comprising:

a first detector disposed facing the first endless belt across a gap to detect the toner image transferred at a predetermined position on the surface of the first endless belt; and an image formation adjustment unit to adjust positions of the toner images formed on the first endless belt based on detection results of the first detector detecting the toner images of different colors formed on the first endless belt.

17. The image forming apparatus according to claim 9, wherein the transferred image detector is positioned to detect the toner image formed on the recording medium when the recording medium is conveyed on the second endless belt, and to detect the toner image formed on the surface of the second endless belt when the recording medium is not conveyed on the second endless belt, the transfer mechanism transferring the toner image formed on the first endless belt onto the recording medium when the recording medium is conveyed on the second endless belt, and transferring the toner image formed on the first endless belt onto the surface of the second endless belt when the recording medium is not conveyed on the second endless belt.

18. The image forming apparatus according to claim 17, further comprising a correction unit to correct detection results of the toner image formed on the surface of the second endless belt obtained by the transferred image detector using detection results of the toner image formed on the recording medium obtained by the transferred image detector.

19. The image forming apparatus according to claim 9, wherein the second endless belt is detachably attachable to the image forming apparatus, the image forming apparatus further comprising a positioning mechanism to position the transferred image detector in the image forming apparatus with reference to the location of the second endless belt.

20. The image forming apparatus according to claim 19, wherein the positioning mechanism positions the transferred image detector by engaging a holding member that holds the transferred image detector with a support member that supports the second endless belt provided in the image forming apparatus.

* * * * *